US007216702B2

(12) United States Patent
Carlson

(10) Patent No.: US 7,216,702 B2
(45) **Date of Patent: *May 15, 2007**

(54) METHODS OF EVALUATING UNDERSATURATED COALBED METHANE RESERVOIRS

(75) Inventor: Francis M. Carlson, Gillette, WY (US)

(73) Assignee: Yates Petroleum Corporation, Artesia, NM (US)

( * ) Notice: Subject to any disclaimer, the term of this patent is extended or adjusted under 35 U.S.C. 154(b) by 397 days.

This patent is subject to a terminal disclaimer.

(21) Appl. No.: 10/789,974

(22) Filed: Feb. 28, 2004

(65) Prior Publication Data

US 2005/0194133 A1 Sep. 8, 2005

Related U.S. Application Data

(60) Provisional application No. 60/527,130, filed on Dec. 5, 2003, provisional application No. 60/451,218, filed on Feb. 28, 2003.

(51) Int. Cl.
*E21B 47/00* (2006.01)

(52) U.S. Cl. ..... 166/250.01; 166/264

(58) Field of Classification Search ..... 166/250.01, 166/250.02, 264; 73/152.01, 152.08, 152.23, 73/152.55

See application file for complete search history.

(56) References Cited

U.S. PATENT DOCUMENTS

| | | | |
|---|---|---|---|
| 2,334,475 | A | 11/1943 | Claudet |
| 3,859,851 | A | 1/1975 | Urbanosky |
| 4,029,576 | A | 6/1977 | Shivers |
| 4,033,874 | A | 7/1977 | Marquardt et al. |
| 4,088,563 | A | 5/1978 | Marquardt |
| 4,098,690 | A | 7/1978 | Semmens |
| 4,234,419 | A | 11/1980 | Coillet |
| 4,247,371 | A | 1/1981 | Roller |
| 4,305,826 | A | 12/1981 | Moses |

(Continued)

FOREIGN PATENT DOCUMENTS

WO WO 9533122 A1 * 12/1995

(Continued)

OTHER PUBLICATIONS

Koval, Eric and Pope, John, Seeing a Reservoir's Character From Solution Gas, Nov. 2006, World Oil.*

(Continued)

*Primary Examiner*—Jennifer H. Gay
*Assistant Examiner*—Daniel P Stephenson
(74) *Attorney, Agent, or Firm*—Santangelo Law Offices, P.C.

(57) ABSTRACT

The evaluation and assessment of geologic formations comprising undersaturated coalbed methane reservoirs. In some embodiments, the present invention provides for inductively quantifying critical desorption pressure of the solid in an undersaturated coalbed methane reservoir from an unrelated substance, the formation water. By using these techniques, the characterization of undersaturated coalbed methane reservoirs may be more quickly and economically made based upon a methane content characteristic such as critical desorption pressure, gas content, and in some embodiments gas content as calculated from isotherm evaluation, estimates of dewatering for production, and ratios of critical desorption pressure to initial reservoir pressure, among other possible characteristics. The features of the invention may further have applicability in combination with conventional reservoir analysis, such as coring, logging, reservoir isotherm evaluation, or other techniques.

190 Claims, 8 Drawing Sheets

U.S. PATENT DOCUMENTS

| | | | | |
|---|---|---|---|---|
| 4,340,391 | A | 7/1982 | Demaison et al. | |
| 4,366,063 | A | 12/1982 | O'Connor | |
| 4,490,845 | A | 12/1984 | Steinbruegge et al. | |
| 4,659,675 | A | 4/1987 | Demaison et al. | |
| 4,664,839 | A | 5/1987 | Reick | |
| 4,883,122 | A | 11/1989 | Puri et al. | 166/263 |
| 4,985,150 | A | 1/1991 | Cronje et al. | |
| 4,994,671 | A | 2/1991 | Safinya et al. | |
| 5,013,450 | A | 5/1991 | Gomez | |
| 5,314,623 | A | 5/1994 | Heskett | |
| 5,405,503 | A | 4/1995 | Simpson et al. | |
| 5,433,856 | A | 7/1995 | Heskett | |
| 5,462,668 | A | 10/1995 | Gallup et al. | |
| 5,571,419 | A | 11/1996 | Obata et al. | |
| 5,622,605 | A | 4/1997 | Simpson | |
| 5,667,695 | A | 9/1997 | Bedard et al. | |
| 5,695,643 | A | 12/1997 | Brandt et al. | |
| 5,785,131 | A | 7/1998 | Gray | 175/46 |
| 6,190,561 | B1 | 2/2001 | Nagan | |
| 6,388,251 | B1 | 5/2002 | Papanyan | |
| 6,462,097 | B1 | 10/2002 | Martino et al. | |
| 6,497,556 | B2 | 12/2002 | Zupanick et al. | |
| 6,521,132 | B2 | 2/2003 | Hughes | |
| 6,572,776 | B2 | 6/2003 | Kuznicki et al. | |
| 6,575,235 | B2 | 6/2003 | Zupanick et al. | |
| 6,609,568 | B2 | 8/2003 | Krueger et al. | |
| 6,678,050 | B2 | 1/2004 | Pope et al. | |
| 6,956,204 | B2 * | 10/2005 | Dong et al. | 250/256 |
| 2002/0178805 | A1 | 12/2002 | DiFoggio et al. | |
| 2003/0048450 | A1 | 3/2003 | Pope et al. | |
| 2005/0194133 | A1 | 9/2005 | Carlson | |

FOREIGN PATENT DOCUMENTS

| | | | |
|---|---|---|---|
| WO | WO 99/00575 | | 1/1999 |
| WO | WO 01/77628 | A1 | 10/2001 |
| WO | WO 02/093126 | A2 | 11/2002 |
| WO | WO 2004/003506 | A2 | 1/2004 |
| WO | WO 2004/003506 | A3 | 1/2004 |

OTHER PUBLICATIONS

American Petroleum Institute: *API RP 44: Recommended Practice for Sampling Petroleum Reservoir Fluids, First Edition*, available through Global Engineering Documents, 15 Inverness Way East, Englewood CO 80150 USA. Phone (800) 854-7179, http://global.ihs.com, Jan. 1966, pp. iii, iv, 1-33.

Amirijafari, B. and Campbell, J. M.: "Solubility of Gaseous Hydrocarbon Mixtures in Water", SPE 3106, *Society of Petroleum Engineers Journal*, Feb. 1972, pp. 21-27.

Craft, B. C., Hawkins, M. F., and Terry, R.E.: *Applied Petroleum Reservoir Engineering, Second Edition*, Prentice-Hall, Englewood Cliffs, NJ, 1991, pp. 33-34.

Crockett, F. and Meyer, J.: "Update and Revision of Interim Drainage Report on Coalbed Methane Development and Drainage of Federal Land in the South Gillette Area, Campbell and Converse Counties, Wyoming T. 40-50 N., R. 70-75 W", available as a download file at http://www.wy.blm.gov/minerals/og/cbmdocs/CBMDrainRpt.pdf, Feb. 2001, pp. 1-16.

Culberson, O. L. and McKetta, J. J.: "Phase-Equilibria in Hydrocarbon-Water Systems III—Solubility of Methane and Water at Pressures to 10,000 psia", *Trans. AIME*, vol. 192, 1951, pp. 223-226.

Donovan, W. S.: "Coalbed Methane Gas Content Determined by Mudlogging Methods", presented at Rocky Mountain Association of Petroleum Geologists Nov. 16, 2001, presentation available at http://www.mudlogger.com/_private/RMAG_011116.pdf, copyrighted by Donovan Brothers, Inc., 2001, pp. 1-31 and 3 page cover letter.

Earlougher, R.C.: *Monograph vol. 5: Advances in Well Test Analysis*, Society of Petroleum Engineers, 1977, ch. 8, pp. 90-104.

Eddy, G. E., Rightmire, C. T. and Byrer, C. W.: "Relationship of Methane Content of Coal Rank and Depth: Theoretical Vs. Observed", SPE/DOE 10800 presented at *SPE/DOE Unconventional Gas Recovery Symposium of the Society of Petroleum Engineers*, Pittsburgh, PA. May 16-18, 1982, pp. 117-119, figs. 1-4 and Table 1.

Gray, I: "Reservoir Engineering in Coal Seams: Part 1—The Physical Process of Gas Storage and Movement in Coal Seams", *Society of Petroleum Engineers Reservoir Engineering*, SPE 12514, Feb. 1987, pp. 28-34.

Keech, D. K. and Gaber, M. S.: "Methane in Water Wells", WWJ, available as a download at http://www.seagrant.umn.edu/groundwater/pdfs/Methane.pdf, Feb. 1982, pp. 33-36.

Koenig, R. A.: "Hydrologic Characterization of Coal Seams for Optimal Dewatering and Methane Drainage", in Methane from Coal Seams Technology, Gas Research Institute (now GTI), Chicago, Nov. 1988, p. 34.

Koenig, R. A. and Schraufnagel, R. A.: "Application of the Slug Test in Coalbed Methane Testing", in *Coalbed Methane*, SPE Preprint Series, No. 35, Society of Petroleum Engineers, Richardson, TX, 1992, pp. 79-89.

McCain, W.D., Jr: *The Properties of Petroleum Fluids, Second Edition*, Pennwell, Tulsa, 1990, pp. 249-251, 444-447.

McCain, W. D., Jr: "Reservoir Fluid Properties—State of the Art", *Society of Petroleum Engineers Reservoir Engineering*, SPE 18571, May 1991, pp. 266-272.

Perry, R. H., Green, D. W., and Maloney, J. O.: *Perry's Chemical Engineering Handbook*, 7th Edition, (McGraw-Hill, 1997), Table 2-137.

Seidle, J.P. and Arri, L.E.: "Use of Conventional Reservoir Models for Coalbed Methane Simulation", CIM /SPE 90-118, presented at The Canadian Instituted of Mining/Society of Petroleum Engineers International Technical Meeting, Calgary, Alberta, Canada, Jun. 10-13, 1990, pp. 118-1 to 118-11 and 6.46.

Sigra—Essential Products and Services, http://www.sigra.com.au/innov.htm, pp. 1-3, Jan. 14, 2003.

Unknown, *Methane from Coal Seams Technology*, Gas Research Institute (now GTI), Chicago, Dec. 1986, p. 28.

Way, S.C.: "Hydrologic Characterization of Coal Seams for Optimal Dewatering and Methane Drainage", *Methane from Coal Seams Technology*, Gas Research Institute (now GTI), Chicago, Jul. 1986, p. 39.

Whitson, C. H. and Brule, M. R.: SPE Monograph vol. 20: Phase Behavior, Society of Petroleum Engineers, 2000, ch. 9, pp. 142-161.

U.S. Appl. No. 60/451,218, filed Feb. 28, 2003, entitled Methods to Determine Critical Desorption Pressure in Undersaturated Coalbed Methane Reservoirs and Methods of Coalbed Methane Reservoir Characterization, 51 pages and 8 drawings.

U.S. Appl. No. 60/527,130, filed Dec. 5, 2003, entitled Coalbed Methane Reservoir Characterization and Sampling Systems, 54 pages and 8 drawings.

Yee, D., Seidle, J.P. and Hanson, W. B.: "Gas Sorption on Coal and Measurement of Gas Content", in *Hydrocarbons from Coal*, edited by Law, B. E. and Rice, D. D, AAPG Studies in Geology #38, 1993, pp. 203-218.

Barker, C. E. et al., USGS Coal desorption equipment and a spreadsheet for analysis of lost and total gas from canister desorption measurements, Open-file Report 02-496.

Bedard, A, Field Pilot Testing, Obtain Good Reservoir Data, KBAR Ranch CBM Pilot Project Hydrologic Testing, Applied Hydrology Associated, Inc.

Bleizeffer, D, An industry in transition, Casper Star Tribune, Sep. 19, 2004.

Bustin, R. Marc et al. Rethinking Methodologies of Characterizing Gas in Place in Gas Shales, AAPG Annual Convention Apr. 1006.

Nuttall, B. C. et al., $CO_2$ Sequestration in Gas Shales of Kentucky, Oral presentation at AAPG Annual Convention, Calgary, Alberta Jun. 19, 2005.

October Tech Review, Welldog, Inc.2005.

PCT Application No. PCT/US05/18323; filed May 24, 2005; Search Report dated Oct. 17, 2005.

PCT Application No. PCT/US05/18323; filed May 24, 2005; Written Opinion dated Oct. 17, 2005.
Pope J, et al., Downhole Geochemical Analysis of Critical Desorption pressure and gas content for carbonaceous reservoirs, 2005.
Pope J., et al., Downho1e geochemical analysis of gas content and critical desorption pressure for carbonaceous reservoirs, 2006 GSPG-CSEG-CWLS Convention.
Pope, J. M., Get accurate, CBM reservoir date; Eandpnet.com, Sep. 2006.
Reservoir Characterization Instrument, Baker Hughes, www.bakerhughes.com, 2000.
Ross, D. et al., Re-Evaluation of Gas Shale Reservoir Characterization: Applicability of CBM Analogues, 2006 CSPG-CSEG-CWLS Convention.
Shirley, K., Shale Gas Exciting Again, Tax Break Rekindled Interest, Mar. 2001, www.aapg.org.
Welldog, Inc. Critical Gas Content, Understanding your reservoir, 2005.
U.S. Appl. No. 11/412,674, filed Apr. 26, 2006, Office Action dated Sep. 28, 2006.

* cited by examiner

Figure 4. Comparison Between Three Ways of Estimating Solution Gas-Water Ratio

Figure 5. Langmuir Fits with Statistical Uncertainty

Figure 6 – Estimated maximum producible methane content with depth and rank

Figure 7. Langmuir Fit to Subbituminous C Curve of Figure 6

Figure 8

#1 Well Content

| | A&C | Henry | Hybrid |
|---|---|---|---|
| BLM coal isotherm | 5.2 | 5.4 | 5.9 |
| Coal Ranked coal isotherm | 13.7 | 14 | 15.1 |

#1 Well Core-taken content = 4.6

#2 Well Content

| | A&C | Henry | Hybrid |
|---|---|---|---|
| BLM coal isotherm | 8.1 | 8.3 | 9.2 |
| Coal Ranked coal isotherm | 18.7 | 18.9 | 20.2 |

#2 Well Core-taken content = 7.1

METHODS OF EVALUATING UNDERSATURATED COALBED METHANE RESERVOIRS

This patent claims the benefit of both U.S. application Ser. No. 60/451,218 filed Feb. 28, 2003 and U.S. application Ser. No. 60/527,130 filed Dec. 5, 2003, each incorporated herein by reference.

FIELD OF THE INVENTION

The present invention relates generally to the evaluation and assessment of geologic formations comprising undersaturated coalbed methane reservoirs. Such reservoirs usually have cleats and fractures initially saturated with water (i.e. no free gas phase exists at reservoir conditions) and may represent gas-water systems. Specifically, the present invention can provide methods of indirectly deducing important attributes relative to methane that is sorbed in a solid formation substance such as coal from tests of other than the coal itself. It permits a determination of critical desorption pressure of methane contained in the solid formations of undersaturated coalbed methane reservoirs and undersaturated conditions of the reservoir in general. In some embodiments, economically significant characteristics can be determined such as estimates of dewatering for production, methane content, among other aspects. The features of the invention may further have applicability in combination with conventional reservoir analysis, such as coring, logging, reservoir isotherm evaluation, or other techniques.

BACKGROUND OF THE INVENTION

Coalbed methane (CBM) is the composite of components that may be adsorbed on coal at the naturally occurring conditions of reservoir pressure and temperature. As pressure is reduced, the CBM begins desorbing from the coal once the critical desorption pressure (CDP) is reached. CBM may consist largely of methane with smaller amounts of impurities, typically nitrogen and carbon dioxide and some minor amounts of intermediate hydrocarbons.

The capture and sale of CBM is a burgeoning industry both in the United States and internationally. In the CBM industry, a typical procedure for CBM recovery is often to penetrate the geologic formation with a substantially vertically drilled well and to either 1) case the hole, typically with steel casing through the coal interval followed by cementing the casing in place and perforating the interval all by methods commonly known in the petroleum industry, or 2) to case in a like manner the hole to the top of the coal and then drill through the coal, perhaps widening the hole drilled through the coal by a process known in the industry as underreaming. The former case is known as a cased completion and the latter is known as an open-hole completion. In either case, when producible water is present, typically water is pumped from the well through a tubing string to the surface in an attempt to lower the reservoir pressure, a generally necessary condition for releasing commercial quantities of CBM in most production scenarios. As reservoir pressure is lowered, a free gas phase will eventually form at the bottom of the hole and most of the free gas then will rise in the annulus between the casing and the tubing by gravitational forces, allowing the relatively buoyant gas to be produced at the surface from the annulus of the casing. The gas produced is then gathered and then typically sent to markets through pipelines.

Many CBM wells that will ultimately produce commercial quantities of coalbed methane do not do so when first put into production. The only gas produced initially in such wells is the relatively minute, generally noncommercial, quantity of gas that is in solution in the water at bottom-hole conditions of pressure and temperature. Most of this minute quantity will come out of solution as the produced formation water moves from conditions at the bottom of the hole to the lower pressure and typically different temperature at the surface. Such coal formations that do not produce gas initially beyond the amount contained in solution in the formation water are said to be undersaturated at reservoir conditions of pressure and temperature. Other definitions for undersaturated coals include: 1) when the storage capacity of the coal, typically expressed in standard (usually 14.7 psia and 60 deg F.) cubic feet of gas per ton of coal, exceeds the actual gas content of the coal expressed in the same units at reservoir pressure, or 2) when no free gas phase exists in the cleats and fracture system at reservoir conditions.

Storage capacity of the coal is typically determined in the laboratory from a captured sample of coal. A plot of the data is often made having the ordinate typically expressed in SCF/Ton and the abscissa being absolute pressure. This data is also often statistically fit with an equation to yield a curve, one such commonly used curve being known as the Langmuir isotherm as described in the reference of Yee et al., 1993. These "isotherms", as the term implies, are measured at constant temperature generally corresponding to that of the reservoir from which the sample was obtained.

Unfortunately, some of the undersaturated CBM reservoirs may never produce commercial quantities of coalbed methane. One concern, therefore, is the determination of whether or not the coals in these undersaturated CBM reservoirs contain sufficient gas to be commercial. Such information, if it could be determined expediently on a given well in an exploratory area, could prevent the drilling of a large number of wells in the specific area that may never produce economic quantities of CBM. As mentioned above, one common method of making that determination is through the process of obtaining a sample of the coal itself, perhaps by coring the coal, and subsequent detailed measurement of gas content of that sample in a laboratory or otherwise. This technique is typically expensive, and can require specialized drilling equipment and personnel. Additional expense may be incurred when the core samples are sent to commercial or private laboratories for analysis. The results of such core analyses are not immediately available, sometimes taking months of desorption time. Also, because core analysis may be too expensive for a large amount of sampling to be taken from a particular well, samples, hoped to be representative, are often selected. Consequently, there is the potential problem of the core samples not being representative of the formation even nearby the well from which the core was cut; and there is an additional problem of how representative the samples will be of the formation at some distance from the well. The CBM industry is replete with examples of how gas content can drastically change over relatively short distances. It is typically neither economically practical nor timely to have every well cored and analyzed.

The results from a sample of the coal itself, perhaps from the coring process, can also be very inconsistent from what is ultimately observed during production. During a coring or other sampling operation, not only are samples of coal pulled for determining gas content in the laboratory, but also a specific sample or a composite sample, possibly made up from drill cuttings, may be gathered and this sample used to determine storage capacity of the coal. This can involve tedious and expensive laboratory processes. The commercial or private laboratory may then compare the gas content measured in some samples with the storage capacity determined from another sample and estimate the degree of saturation of the coal. As explained above, if the measured gas content is less than the storage capacity, the coal is said to be undersaturated with gas, and the laboratory will typically determine the pressure at which the gas content intersects a plot of the storage capacity data. The resulting pressure is typically referred to as the critical desorption pressure (CDP). The CDP is the reservoir pressure at which CBM will start to desorb from the coal with reduction of reservoir pressure, become a gaseous phase, and begin to become capable of production in commercial quantities.

Unfortunately, the value of CDP determined by the laboratories, too frequently, has been grossly in error from what was ultimately observed when the wells were produced. The present inventor has identified such error in the coring and subsequent laboratory analyses of several of approximately ten wells, analyzed under traditional core analysis using different laboratories. Some analyses have indicated that the reservoirs are saturated at reservoir pressure, yet these reservoirs have not produced any commercial quantities of gas until the reservoir pressure has been drawn down to at least 50 to 60% of the initial reservoir pressure before reaching the CDP. Some of the analyses indicate that the gas contents exceed the storage capacities of the coals at reservoir pressure, something that appears to defy an adequate physical explanation.

In summary, coal sampling, coring, and subsequent core analyses as described above may lead to results that are not only time consuming and expensive to obtain, but also they can be highly questionable and frequently inconsistent when used for individualized analysis. For individualized analysis, due to uncertainty, the better use for coal sampling, coring, and core analyses may not come from individual assessments but instead from multiple assessments from which composite isotherms are constructed for a given geological region by averaging of the data and statistically demonstrating the uncertainty. This has been done in the Powder River Basin (PRB) by the United States Bureau of Land Management (BLM) as described in the reference to Crockett and Meyer, 2001. For example, from some 40 samples, the BLM has constructed an averaged synthesized isotherm for samples measured in the PRB representing these 40 samples. Even from such a relatively large number of samples, and ignoring the cost challenges to achieve such data, this effort highlights the challenges in a coal sampling approach because uncertainty in the data still exists. In fact this data shows significantly differing isotherms that represent one standard deviation on either side of the mean curve.

Another problem under traditional analysis can, and does, occur in some undersaturated CBM reservoirs when one tries to demonstrate, perhaps through individual testing or small-scale pilots of several adjacent wells, that the well(s) will ultimately produce commercial quantities of CBM. A long and uncertain dewatering period, even under the best of circumstances, may be required before any commercial quantities of CBM are produced. This can lead to long periods of evaluation time. In some areas where there is high permeability and strong aquifer support, such as can be the case in the PRB, one well cannot draw down the pressure sufficiently to ever reach the CDP in any sort of practical or economic time frame. In response to this problem and in an effort to evaluate their leases, most operators have drilled costly (multi-million dollar) multiple-well pilots in an effort to cause interference between wells so that these wells, in combination, can draw the pressure down sufficiently to reach the CDP by exceeding the water influx into the pilot area. Some of these pilots have been successful in the PRB, but some of the pilots have been dewatering for over three years without yet producing commercial quantities of CBM. This dewatering is done at considerable cost of equipment and power to pump wells, at a financial cost of deferred revenues and with the uncertainty that the ultimate resource to be found may not be sufficient to be profitable.

The practical challenges of laboratory involvement and sampling difficulty known to exist in a coal sampling-based technique are perhaps highlighted by reference to U.S. Pat. No. 5,785,131 to Gray. Although this reference involves techniques for sensing formation fluids as in gas-oil systems when the fluid itself is of interest, as it relates to the very different aspect of sampling solids containing a substance of interest, it proposes a system for pressurized capture of the samples from entrained particles during drilling. In the reference, these particles of coal or the like are captured and tested on site to avoid some of the mentioned challenges of laboratory testing. As it relates to the solids such as are of interest in the present invention, however, this reference still relies on a capture of the entrained particles and as such it is subject to the uncertainties and other practical limitations discussed above.

Another alternative to those techniques based on sampling of the coal itself involves the use of mudlogging during drilling to obtain, at least a qualitative indication of the presence of CBM. Some have even tried to quantify results (Donovan, 2001), but these techniques can leave much to be desired and problems can exist because the system is not usually closed, thus allowing unmeasured gas to escape. Gas-free drilling water is also typically mixed with formation water of different gas content. Further, particle size can need to be estimated, drilling speed recorded, etc. Then, too, results observed by the inventor for the PRB seem to indicate gas contents that are typically far in excess of those observed. Finally, such techniques provide, at best, an estimate for gas content of the coal and do not provide the practical accuracies desired, neither do these techniques provide an estimate for CDP.

Other than the coal sampling-based techniques mentioned above, efforts (e.g., see Koenig, 1988) have included attempts to determine CDP by producing the well and dropping the pressure, perhaps by bailing or by a pump lowered into the well until gas starts being produced. These techniques can be fraught with problems, some of which are: 1) if a pump is used in the well, its capacity may not be sufficient to draw the well down in a practical testing time frame to determine when gas starts being produced; 2) as the liquid level drops in the well, air may be pulled into the casing from the surface, if the casing is open at the surface, because the pressure in the casing will likely be lower than the atmospheric pressure at the surface, or if the casing is isolated from atmospheric pressure (e.g., shut in) a vacuum may be drawn on the well and a negative gauge pressure (in this document gauge pressure will refer to measurement of pressure above atmospheric pressure where zero gauge pressure would correspond to atmospheric pressure) may result until there is sufficient release of gas from the coal to overcome the vacuum being drawn by the falling liquid level; and 3) by the time the pressure is drawn down sufficiently to see gas production at the surface, the reservoir may already be affected by two-phase flow that may lead to complications in interpretation. This can also produce results inconsistent with later production history.

SUMMARY OF THE INVENTION

Accordingly, broad objects of the invention may include providing techniques and systems to evaluate undersaturated coalbed methane reservoirs and determine particular characteristics of the coal in such reservoirs from other than a sample of the coal itself. Further broad objects may include providing techniques and systems to determine critical desorption pressure of coalbed methane reservoirs and other reservoir characteristics such as characteristics that may be relevant to economic viability or the like. Each of the broad objects of the present invention may be directed to one or more of the various and previously described concerns.

Further objects of the present invention may include the characterization and evaluation of undersaturated coalbed methane reservoirs based upon characteristics such as critical desorption pressure, gas content, gas content as calculated from isotherm evaluation, estimates of dewatering for production, and ratios of critical desorption pressure to initial reservoir pressure, among other possible characteristics as presently disclosed.

Other objects of the present invention include characterization and evaluation of coalbed methane reservoirs consistent with the techniques presently disclosed and potentially in combination with conventional reservoir analysis, such as coring, logging, reservoir isotherm evaluation, or other techniques. Naturally, further objects, goals, and advantages of the invention are disclosed and clarified throughout this disclosure and in the following written description.

To achieve the above-recited objects and the other objects, goals, and advantages of the invention as provided throughout this present disclosure, the present invention may comprise techniques and systems of testing a substance other than the coal or other solid actually of interest in order to inductively quantify a methane content characteristic for sorbed methane in the solid; to understand any factor that bears directly or indirectly on methane content, including but not limited to bubble point, critical desorption pressure, gas-water ratio, or the like. This invention even shows that a test of a characteristic of the formation water, a substance whose characteristics may have been generally thought to be unrelated to the amount of methane sorbed on the solid coal, can be used qualitatively and quantitatively to determine gas content or the like of coal. In addition, the invention shows that the test of the water can even permit inductive quantification of the critical desorption pressure of the coal in an undersaturated coalbed methane reservoir. By inductive quantification, it can be understood that the result is surprising, based on previous knowledge of a person of ordinary skill in the art, in that it is a previously-thought-of-as-being-unrelated-value that yields the desired result. From this method, determinations can be deduced and inferred and the result can be obtained earlier and less expensively than previously done. In some preferred embodiments, the invention includes a method of determining critical desorption pressure of an undersaturated coalbed methane reservoir comprising the steps of: determining a solution gas-water ratio of formation water of the reservoir; determining the bubble point pressure of the formation water corresponding to the solution gas-water ratio; and determining critical desorption pressure of the reservoir from the bubble point pressure of the formation water. In other preferred embodiments, the invention includes a method of determining critical desorption pressure of an undersaturated coalbed methane reservoir comprising the steps of determining the bubble point pressure of the formation water of the reservoir and determining critical desorption pressure of the reservoir from the bubble point pressure of the formation water.

To further achieve the above-recited objects and the other objects, goals, and advantages of the invention as provided throughout this present disclosure, the present invention may comprise methods of undersaturated coalbed methane reservoir characterization and characterizing the coalbed methane reservoir from characteristics such as: critical desorption pressure, gas content, gas content as calculated from isotherm evaluation, estimates of dewatering for production, and ratios of critical desorption pressure to initial reservoir pressure, among other possible characteristics as presently disclosed. The invention may also include determinations of critical desorption pressure and characterization of undersaturated coalbed methane reservoirs in combination with conventional reservoir analysis, such as coring, logging, reservoir isotherm evaluation, or other techniques.

The present invention teaches that the bubble point of the formation water can be used to inductively quantify the CDP of the coal in the coalbed methane reservoir and that there is no requirement that the formation water remain in contact or carry with it coal as may have been thought necessary. Thus, through embodiments, the CDP of coal in an undersaturated coalbed methane reservoir may be quickly, easily, accurately, and relatively inexpensively determined by the use of one or more CBM wells in an area, and an excellent estimate of gas content can now be made. Further, as mentioned, an estimate of the amount of dewatering necessary to reduce the reservoir pressure from its initial value to the CDP can now be estimated in a practical manner.

Importantly, by knowing the CDP in a practical manner, ultimately an economic analysis can now be made of the prospect a priori the drilling of a large number of pilot wells, potentially at tremendous savings in time and investment costs to the operators. Further, by the CDP being known in a practical and more economic manner such as disclosed as part of the present invention, it is now possible to use an isotherm to determine gas content of the coal. Additionally, one can now more practically use an isotherm specifically measured for an area, can use an isotherm determined in accordance with techniques such as core analysis, may use correlations similar to the aforementioned BLM correlations for a given geologic area, or even may (admittedly with less precision) even use very general correlations based on rank of the coal such as are publicly known (Eddy et al, 1982). Finally, through the present invention, one may not even have to use an isotherm at all, but may be able to use the CDP to rank prospects for development in a given geologic area where the variations in gas content may be due to varying degrees of undersaturation.

The previously described embodiments of the present invention and other disclosed embodiments are also disclosed in the following written description. The entirety of the present disclosure teaches, among other aspects, a novel and nonobvious method of characterizing, among other things, undersaturated coalbed methane reservoirs of gas-water systems, and other techniques that circumvent many of the problems of timeliness, inaccuracy and expense identified above for other state-of-the art methods.

BRIEF DESCRIPTION OF THE DRAWINGS

FIG. 8 (also referred to as Table 1) is a table of comparisons between gas content determined from desorption of cores and various determinations of gas content from the determination of CDP in accordance with the present invention.

DETAILED DESCRIPTION OF THE PREFERRED EMBODIMENTS

Figure 1:
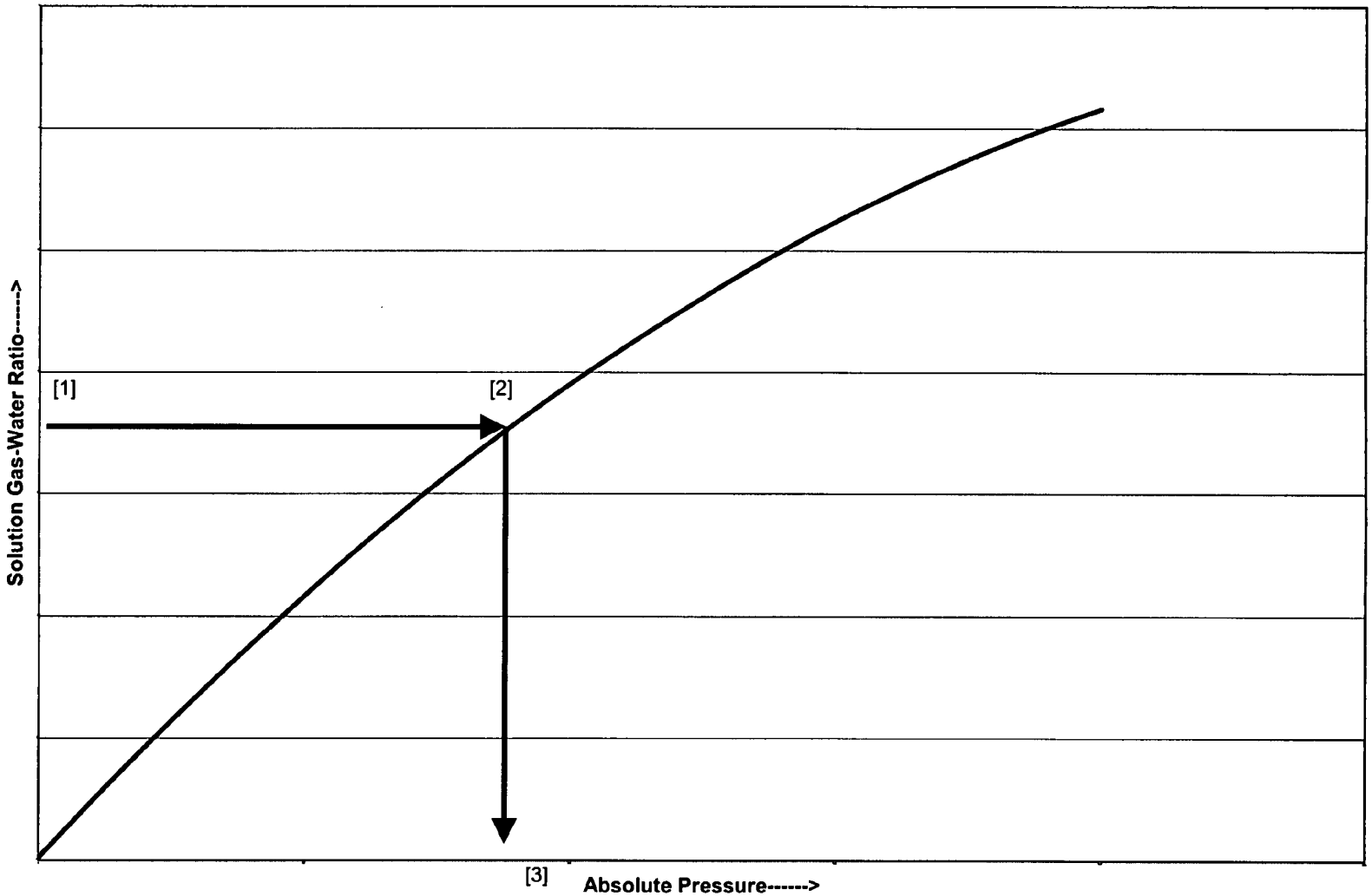
FIG. 1 shows a relationship between solution gas-water ratio and bubble point pressure such as might be determined in the laboratory at a given temperature and salinity.

As summarized above, this invention involves new methods to evaluate a gas-sorbed solid in a practical manner. Although initial applicability is envisioned for methane such as may be contained in solids in commercial quantities such as an undersaturated coalbed methane reservoir, it should be understood that it may be expandable to other solids and other gases in appropriate circumstances. In initial application it involves a situation where a well exists for a reservoir and sampling is accomplished of a substance other than the solid itself from the reservoir. In a preferred embodiment, the substance is the formation water present in the reservoir containing a solid such as coal. This formation water is essentially uncoupled from any contact with the coal and removed from the reservoir containing the solid and is tested in a relatively easy manner to quickly yield information that permits an inductive quantification of some characteristic of the solid in the reservoir. This characteristic may be a methane content characteristic, that is information or data from which aspects relative to or influenced by actual content data for the reservoir can be determined. From the inductively quantified methane content characteristic, some characterization of the reservoir can be accomplished. The invention can be embodied in several different ways and at least some of those envisioned as the best ways to accomplish it are described below. Each feature of the present invention is disclosed in more detail throughout this application, such as in the following written description.

In one embodiment, the invention can involve a determination of a solution gas-water ratio for the formation water of the reservoir. When a quantity of gaseous phase is placed in contact with water and well mixed, all or a portion of that gas will go into solution in the water. If all of the gas goes into solution leaving still a single phase of water, the water is said to be undersaturated with respect to the gas. This means that the water can still allow more gas to go into solution if the water were to be placed in contact with an additional quantity of gas and well mixed. At some point, however, the water will become saturated. In theory, the water is said to be saturated when addition of an infinitesimal amount of gas well mixed with undersaturated water will cause the existence of two phases in equilibrium, a gaseous phase and a liquid water phase. The amount of gas that can be held in solution in water is a function of pressure and temperature of the water, components of the gaseous phase, and the amount of impurities in the water (e.g. salt concentration). The pressure at which the water becomes saturated with gas is called the bubble point, so called because this is the unique pressure for a given temperature and fluid composition where the first "bubble" of gas could exist as an independent phase separate from the liquid water. As pressure increases, the amount of gas that can be held in solution in the water increases. Over the range of temperatures typically encountered in CBM reservoirs, the amount of gas that can be held in solution increases very slowly with decreasing temperature. In the course of production of a CBM reservoir, in a specific locality, the only one of these variables that is apt to exhibit major change in the reservoir proper is pressure. However, once the fluids leave the conditions existing in the reservoir, become uncoupled from the reservoir, and start making their way to the surface by any means of conveyance that might be present and through the production facilities, pressure and temperature also change. These changes in pressure and temperature impact not only the amount of gas that can be contained in the water, but also the volume of free gas (i.e. the gas that is not in solution) that may form on the way to the surface. For this reason, it is convenient to represent the amount of solution gas present in a given volume of water at reservoir conditions in terms of relative volumes at standard conditions. This standard is typically atmospheric pressure at sea level (~14.7 psia) and 60 degrees Fahrenheit. Thus, a common unit for solution gas-water ratio is SCF/STB (standard cubic feet of gas per stock tank barrel of water). There are a variety of ways to determine solution gas-water ratio in accordance with the invention.

One method of determining solution gas-water ratio for the formation water is to obtain a bottom-hole sample of undersaturated formation water and determine the solution gas-water ratio and perhaps bubble-point in a laboratory. For the purposes of this invention, a general objective of collecting a bottom-hole sample would be to obtain a representative sample of formation water as a single liquid phase, but containing gas in solution at or near the existing reservoir pressure and temperature. Standards have been written for obtaining bottom-hole samples of undersaturated oil. The goal here is to capture substantially pure formation fluid (that is fluid not tainted or contaminated by drilling fluids or the like) and to assure that the formation water sample obtained is truly representative of that existing naturally in the formation. The methodology employed and described in detail in these standards is directly applicable to the procedure of obtaining a bottom-hole sample of formation water, and thorough treatment and nuances of the methodology can be found in the reference listed as that of American Petroleum Institute, 1966 that would encompass the following abbreviated description. Basically in obtaining an appropriate sample, existing reservoir temperature and pressure may be measured and recorded. In order for the sample to be representative of the formation water, the well should be produced for a period long enough to remove all remnants of foreign fluids introduced during the process of drilling and completion. The pressure should be lowered at the bottom of the hole adjacent to the formation so that reservoir fluids will move from the formation to the wellbore. During this production period, a small drawdown (drawdown is the difference between the reservoir pressure and the bottom-hole producing pressure) is recommended so that the pressure does not drop so low as to go below the bubble point pressure of the formation water during sampling. If the bottom-hole pressure drops below the bubble point pressure of the formation water, two phases may exist when the sample is taken at the bottom of the hole so that capturing the appropriate amount of gas and formation water in the appropriate proportions can become a significant problem. To obtain the sample, the well could continue to be produced at a slow rate or it could be shut-in just prior to sampling depending upon the configuration of the well and sampling equipment. A sampler described in the standards may be lowered in the well to a level typically adjacent to the formation and a sample drawn. The sample may then be remotely sealed to effect contained sampling at the bottom of the hole at or above reservoir pressure, brought to the surface, and transported to the laboratory for analysis commonly referred to in the petroleum industry as PYT (pressure-volume-temperature) analysis. Solution gas content of the formation water may also be determined in situ by a downhole measuring device.

If the well is being pumped or otherwise produced during the sampling of the well, at least one representative sample could even be collected at the surface. This sample could even be tested on site for the particular characteristic of interest. One embodiment of the invention may comprise a fluid control such as a valve at the surface. The valve may be closed during pumping until the pressure upstream of the valve exceeds an estimate of the bubble point of the water, and consequently the CDP of the coal. A reasonable guideline would be to adjust the valve until the pressure upstream of the valve, is at or above the static bottomhole pressure, perhaps after a few days of shut-in prior to obtaining the sample. Placing the pressure ahead of the valve above the static bottomhole pressure could help to assure representative samples, such as to assure that the typically small effect of temperature change from bottomhole conditions to surface conditions would not change the phase relationship from single-to two-phase ahead of the sampler. In this manner, the sample collected upstream of the valve and at the pressure ahead of the valve, may be more representative as single-phase when captured. Samples could then be sent to a laboratory for analysis, potentially after having been adjusted to reservoir temperature. Also, whether or not taking the temperature effect into account and/or other such effects, one could make an approximation of bubble point pressure and/or solution gas-water ratio on site by reducing the pressure on the sample and observing the relative volumes of gas and water at atmospheric pressure such as through a sight glass or by other indicator if the sampler is so equipped. Further on-site expedients to obtain an estimate of the bubble point of the water could include: 1) acoustic detection of two-phase flow by lowering the pressure upstream of the valve until an audible difference is noted between single-phase and two-phase flow with the corresponding value of upstream pressure being an approximation for the bubble point, and 2) by noting the contrast in frictional head loss in going from single- to two-phase flow such as could be accomplished, for example, by measuring the differential pressure drop in a section of the pipe upstream of the valve.

If accomplished at a laboratory, a suite of measurements can be made on the sample of undersaturated formation water. Regardless as to where made, testing can include determination of solution gas-water ratio perhaps either by making a single determination by dropping the pressure to some prescribed low pressure, perhaps at approximately zero absolute pressure, and measuring the amount of gas released in the process and dividing this by the volume of water in the sample. In addition, one can test for the solution gas-water ratio at only a prescribed number of pressures so that a solution gas-oil ratio versus absolute pressure curve can be constructed. This option may be preferable because of its broad application as described below with regard to bubble point determination features.

In determining the solution gas-water ratio, it is possible to utilize or determine a variety of gas and other factors, including but not limited to the composition of the released or obtained gas (methane, carbon dioxide, etc.), the surface temperature, the surface pressure, the gas remaining dissolved after the test, and to factor these aspects into the test results. It is also possible to utilize or determine the composition of the formation water and to factor these aspects as well into the test. Of importance in this regard can be the effect of salt concentration.

It is recommended in some embodiments that the full suite of tests, if made at all, be made only on one or a few wells in a new area of development. The solution gas-water ratio as a function of absolute pressure obtained in the process could then be used to determine the bubble point pressure of the formation water and the CDP of the reservoir as taught here. Some or all of the data conducted on the samples given the full suite of tests can then be applied to other samples and other wells in the new area and this may yield results that are more accurate than the use of general, theoretical or published correlations.

Another method that can be used to determine the solution gas-water ratio of the formation water by measurement of produced quantities of gas and water: Although this method may produce results slightly less accurate than results from bottom-hole sampling, when the time and expense of obtaining and analyzing bottom-hole samples is taken into consideration, direct measurement may be the preferred way to determine solution gas-water ratio. As in bottom-hole sampling, it may be desirable that the formation water be a single phase at bottom-hole conditions with the only gas present at bottom-hole conditions adjacent to the formation being that which is in solution in the formation water. Indeed, if it is not single-phase at conditions existing in the coal, then the reservoir is likely saturated and the invention described here may be neither necessary nor applicable. It may not be necessary because if it is known that the coal is saturated, one only need record the existing reservoir pressure (e.g. perhaps by equating the bottom-hole pressure, after sufficient shut-in, to the reservoir pressure). The reservoir pressure (i.e. when two phases exist) would correspond to the current desorption pressure and this fact would be recognized by most skilled in the art.

When the formation water is undersaturated—as of interest in the present invention—the reservoir pressure is higher than the bubble point pressure of the formation water. In such a situation, the solution-gas/formation water ratio can be directly measured or tested in accordance with the present invention by testing produced quantities of gas and water. In this embodiment, it is usually desirable to keep the bottom-hole pressure higher than the bubble point. This can be done by producing the well at very small drawdown (the difference between reservoir pressure and bottom-hole producing pressure) so that the bottom-hole producing pressure is kept above the bubble point pressure. Since one does not know a priori the bubble point pressure (indeed that is what is being sought), it can be practical to assume that the bubble point pressure is below the producing bottom-hole pressure and then verify that assumption during the measurement and subsequent estimation of bubble point pressure. After a well is completed, is in communication with the coal formation, and is shut in for a sufficient period to allow the bottom-hole pressure to become the same as the reservoir pressure, one can then measure the pressure of the fluids immediately in contact with the wellhead at the surface. If there is negative gauge pressure (psig) present at the surface, the well is actually drawing a vacuum. This can be caused by: 1) some reduction in reservoir pressure (perhaps by production of nearby wells), or 2) by the bottom-hole pressure being higher than the reservoir pressure (perhaps achieved while drilling) when the well was shut-in before the bottom-hole pressure had a chance to fall off to the reservoir pressure. Regardless of the cause and to use this production method, such a well will have to be produced by artificial means such as by a downhole pump. Such a condition can be taken as strong evidence that the fluid at the bottom of the hole is a single water phase and if fluids there are representative of the formation, therefore, strong evidence that the coal is undersaturated. If the gauge pressure of the fluids in contact with the surface of the shut-in well is zero and if there is communication between the well and the formation, this again may be taken as an indication not only that that the well will most likely have to be produced by artificial means to conduct the test, but that the coal is undersaturated, and that the bottom-hole pressure was equal to formation pressure at shut-in. If the gauge pressure at the surface of the shut-in well is positive, then it may be important to know what fluid is at the surface of the well. This can be accomplished by opening a valve at the surface. When the valve is opened, if the well continues to flow gas, even at a small rate for a long period (perhaps several hours to several days), this may be taken as a good indication that the well is two-phase at bottom-hole conditions and, as explained above, the coal is probably saturated and the shut-in bottom-hole pressure will be at or near the current desorption pressure of the coal. If the well quickly (perhaps less than 15 minutes) quits producing any gas and is not followed by any water production when the valve is opened, then the pressure on the casing could have been caused by some other phenomenon (e.g. the well may have been producing water and the well shut in at the surface before the bottom-hole pressure had a chance to build up to the reservoir pressure). Such a well may have to be produced by artificial means in order to conduct the test. If the well begins to flow or immediately flows only water or mostly water when the valve is opened, then the well will likely flow on its own without artificial means and is called a "flowing" well.

More than likely when the casing pressure is accompanied by water at the surface with little or no gas preceding it, the reservoir is undersaturated and the well can be tested and the solution-gas ratio determined directly just by opening the valve and by producing it through separation facilities that will allow the calculation of producing gas-water ratio. On the way to the surface, the pressure in such a situation drops in the fluid from its high at bottom-hole conditions, to its low at the surface at atmospheric pressure. When the transported fluid reaches its bubble point on the way to the surface, gas breaks out of solution and forms an independent phase. More and more gas comes out of solution as the transported fluid reaches lower and lower pressures on its way to the surface. One embodiment of the present invention makes use of the fact that eventually, but usually within minutes, a stable rate can be achieved perhaps with the aid of a choke valve installed at the surface and altering the setting on that valve to alter the production rate. At the surface, the mixture of water and gas may be routed through separation facilities, so that the producing gas-water ratio (i.e., the ratio of produced gas at standard conditions to the volume of water produced) can be directly determined. In such a situation it may be desirable that there be a constant fluid production, that is that the water production rate be held relatively constant during several determinations of the producing gas-water ratio over the course of several hours or perhaps as long as a day. Initial sampling can occur, followed by additional production, and then additional sampling, with comparison of test results or comparing samples. In applying the invention taught here on newly drilled wells, the inventor has found that a good system is to start production on one morning, make a measurement at the end of the workday and come back the next morning or at least longer than a traditional formation water re-sampling time and make another measurement using similar tests to determine accuracy. In this manner, comparing the results of the multiple similar tests can yield an accuracy determination. If the preceding day's producing gas-water ratio is essentially (within the uncertainty of the measurement employed) the same as the one obtained the next morning then the conditions in the formation adjacent to the bottom of the well are single-phase and the value of producing gas-water ratio is approximately equal to solution gas-water ratio of the formation water. In many cases, the determination can be made over the course of several hours, but the inventor has seen at least one case where the measurement did not become constant until the following day. In existing producers that have been under production for some time but are not yet producing commercial quantities of CBM, the results can be obtained very rapidly because presumably all remnants of foreign fluids introduced during drilling would be gone. Of course, the latest measurement should be most representative of the formation water as long as the bottom hole pressure remained above the bubble-point pressure during the course of the test. Any sort of trend in the data with time may be considered troublesome. If there is any sort of trend in the data with time or production rate, either increasing or decreasing with increasing rate, then the bottom-hole producing pressure may have dropped below the bubble-point pressure of the formation water during the test period and the value of producing gas-water ratio may not be fully representative of the solution gas-water ratio. Also, in severe cases of invasion of drilling fluid or stimulation fluid into the formation, the measurement may not be representative of the formation water. If such concerns exist, the production test could be extended over several days until it is possible to achieve a constancy or at least substantially constant producing gas-water ratio or other parameter (e.g., bubble point, CDP, etc) so that the sampling yields a constant result whatever it may be. This inventor has gone back after a week or two of production on several occasions and determined that the same producing gas-water ratio existed as before. One could also utilize on site a chromatograph to analyze the gas coming out of the water during the test to assure that the components measured are consistent with known compositions of CBM in the area. Such consistency would suggest that the test had been run long enough. High values of nitrogen might, for example, suggest that the gas in the water is contaminated by air introduced during drilling or underreaming and a longer period of production might be required to get water entering the pump that is representative of the formation water.

As implied from the earlier discussion, when the gauge pressure of the fluids at the surface is either negative or zero, the well will not flow on its own volition and some type of production equipment may be required to perform the test. Production equipment can vary tremendously regarding the types of pumps and well configurations for those pumps, but in this document, only one example will be given as the various pumps and pump configurations are generally known in the industry. This should not be viewed as limiting, however. In many geological basins including the Powder River Basin, a submersible pump is lowered on the end of production tubing to the approximate depth of the coal formation. In some applications, no packer is used to isolate the producing zone from the annular volume in the well above the packer. When there is no packer, frequently the wellbore, either as created by the original drilling process or enlarged by other means, is used as a bottom-hole separator where it is intended that, once gas begins to flow as an independent phase, most of the gas will be forced by buoyancy up the annulus between the tubing and casing, allowing water and a typically insignificant amount of gas to flow up the tubing. The gas that flows up the annulus is often gathered at the surface and sold. The small amount of gas that comes from the tubing is, however, typically vented and not captured. This configuration can be used to determine the producing gas-water ratio and ultimately the solution gas-water ratio. For the purposes of this determination, it may be beneficial to locate the pump close to the formation on the end of a tubing string for two reasons: 1) A lesser amount of water needs to be removed to start retrieving fluids representative of the formation water than if the pump was located farther up the hole, and 2) more importantly, the pressure can be maintained high enough to exceed the bubble-point pressure of the formation water before entering the pump. In accordance with one embodiment, the pump may be turned on at a practical, but relatively slow rate with limited drawdown in an effort to keep the bottom-hole pressure above the bubble point pressure at the bottom of the hole during the course of the test. The water production rate may then be stabilized. When the water production rate no longer requires frequent adjustment, then the measurements may begin. Alternatively and preferably, a pressure transducer can be installed above the pump so that the fluid level can be observed during the test. In this embodiment, when the fluid level does not change significantly, then the measurements may begin. With the fluid level relatively constant in the well, fluids entering the pump will be largely those coming from the formation and not fluids that might not be representative of the formation that could be pulled into the pump from the annular volume between the tubing and the casing above the formation. Alternatively, a packer could be set to isolate the fluids in the annulus above the pump from the fluids below the pump. The water then enters the tubing at the bottom of the hole as a single water phase. At this point the test proceeds in essentially the same manner as that described at above for a flowing well, with the same attempts to make the direct measurement indeed be one of a sample that is representative of the virgin formation water. As in the case of a flowing well, the produced fluids or a portion of the produced fluids are taken to separation facilities where an accurate determination of producing gas-water ratio can be made. Several measurements of producing gas-water ratio can be made; and in some embodiments should be made over the course of hours, a day, or even a week as discussed above for the flowing well case. As before, if any sort of trend is evident in the data with time or rate, or if the producing gas-water ratio does not approach some constant value, there is a chance that the measured producing gas-water ratio will not be representative of the solution gas-water ratio of the formation water and consequently, the value of CDP ultimately obtained may not be accurate.

Sometimes the well will be so severely damaged or the permeability of the formation so low that the pump cannot operate at such a low rate to keep the fluid level constant. An option in accordance with an embodiment of the present invention may be to pump off the well, in essence permitting an inappropriately low pressure and producing substantially all of an initial well volume, and then allow the well to rebuild pressure, to refill over the required time (perhaps several days) to at or near its original fluid level. The well can then be produced, and once one well or well pathway volume above the pump has been produced in some embodiments, sampling may commence. It may be preferable to sample before the fluid level drops too low to be representative. These first sampled fluids, collected after the displacement of one tubing volume, are more likely to be representative of the formation fluid under adverse situations such as a tight reservoir and/or severe well damage. Conducting the test in this manner cannot be expected to yield results as what could be achieved with a longer test, but it may allow salvaging a test that might otherwise be aborted.

Other methods of determining solution gas-water ratio may also be used in various other embodiments of the present invention. Any method of determining the solution gas-water ratio would be consistent with the features taught of the present invention and is a relevant step in combination with other features and in application of the invention. These may range from low-tech systems and techniques to more advanced methods perhaps even including the separation and pressure measurement methods of the Gray patent reference where one releases a limited amount of pressure and observes a pressure buildup. For example, it is also possible that a representative sample of formation water could be obtained through the drill stem in a procedure that would fall under the general category of drill stem testing as discussed by the Earlougher reference, 1977. Drill stem testing is a way of temporarily completing a well during the process of drilling so that evaluations of the formation and formation fluids can be made without the expense of completing and casing a well. In drill stem testing, a tool is often lowered into the hole at the end of the drill pipe, the zone of interest is isolated by formation packers and the drill pipe is used to transport fluids from the formation to the drill stem and these fluids can be sampled and analyzed for fluid properties. With the caveat that precautions should be taken to assure that any sample of formation water is truly representative samples obtained through the drill stem sampling technique can be used in embodiments of the present invention. If adequate pressure exists, then the well could be flowed at the surface, and determining the solution gas-water ratio could be determined as described above for the case where a positive fluid pressure exists at the surface. Optionally, a pump could be run in on the drill string or on tubing by the drlling rig and a test could be conducted in a manner similar to the techniques described here. This would have the advantage of obtaining immediate results, but the disadvantage of having to pay rig time while the test was being conducted.

As another technique, at least one company, Welldog, Inc., is aspiring to come up with means of determining the gas content of the coal formation by a tool for which a patent application has been filed. While this tool is designed to specifically determine the CBM content of coals, presumably it, or a similar device based on the same concept, might also be used to obtain and test formation water and to then achieve the present invention.

As yet another example, it might also be possible to locate the pump higher up in the hole, at a location remote from the reservoir, instead of adjacent to the formation in the situation where a pump is installed to test the well as described above. This situation might result in an accurate assessment depending upon how low the bubble point of the formation water actually was. If gas begins to come out of solution below the pump, however, the results could be very hard to interpret as part of the gas could go up the annulus and part would go through the pump. The gases from both the production tubing and the tubing-casing annulus could also be combined at the surface to effect a contained sampling of both the formation water and the gas, essentially the total gas content of the water. Solubilized and desolubilized methane can be captured to effect an accurate determination. These two can then be measured through separation equipment. As long as the bottom-hole pressure at the well bottom remains above or at least at the bubble point of the formation water, and no phase separation is permitted at this location, this recombination of gases and measuring of the production rate of the recombined amount divided by the production rate of the water could lead to a reasonable value for solution gas-water ratio by equating it to the producing gas-water ratio. Interpretation could be complicated by not knowing for certain that the bottom-hole pressure was above the bubble point of the formation water. As previously mentioned, if the reservoir pressure drops below the bubble point pressure of the formation water, the results could be impacted by potential two-phase flow in the formation that could lead to producing gas-water ratios that might not be representative of the solution gas-water ratio for the formation water.

It is also possible that one might note when gas first starts being produced from the casing-tubing annulus when production tubing and pump are installed in the well. One could then place a backpressure on the well at the surface and consequently raise the bottomhole producing pressure. If the bottom-hole pressure rises to a level that would be above the bubble point of the formation water at bottom-hole conditions, the gas would go back into solution and flow from the casing-tubing annulus would cease with the desirable result that the fluids at the bottom of the hole would be a single phase. This could lead to a fairly accurate estimate of solution gas-water ratio as determined from the producing gas-water ratio with the risk that the re-solution of the gas in the water may be in proportions not representative of the formation water.

As mentioned above, direct measurement of solution gas-water ratios can involve separation and volumetric testing of the gas and water. The separation facilities through which the produced fluids may be passed can be any convenient facilities. Several separation facilities are considered in a document prepared by the Michigan Department of Public Health (Keech and Gaber, 1982) hereby incorporated by reference. The facilities can include those that are commercially available that are normally used for the surface separation of reservoir fluids in the oil industry or perhaps modified to measure quantities of fluids more precisely. If such facilities are not in place, they may not be convenient because of the logistics of moving them from one place to another perhaps because of their large size, etc. Facilities that may be convenient include: a bubble-pail device and a separation barrel device.

The bubble-pail device is discussed by Keech and Gaber, 1982. Simply stated, the bubble pail may be any suitable container (e.g., a five-gallon bucket) through which a riser pipe may be mounted with a stand located some distance down on the riser pipe and attached to it. At the top of the bucket may be located an outlet. The produced fluids from the well or a portion of them may be routed through the riser pipe and allowed to fill the bucket so that water is flowing from the outlet on the top of the bucket. Valves can be adjusted upstream to achieve a manageable rate of flow through the bucket and that rate can be determined by collecting a known volume of water flowing from the bucket over a given period of time. Once the rate has stabilized through the bucket, a calibrated, open-ended transparent vessel may be filled with water and inverted so that the vessel remains completely filled with water with no air or gas pockets at the top (actually after inversion the bottom of the vessel becomes the top). To make a measurement, simultaneously, the inverted gas-collection vessel is moved over the top of the riser pipe and held in place resting on the stand and a container is placed under the outlet of the bucket. Gas floats to the top of the vessel and water goes out the opening of the vessel and into the bucket. At some convenient point, both the vessel and the container may be withdrawn perhaps simultaneously. By measuring the amount of water in the container and the amount of gas in the vessel, an estimate of producing gas-water ratio can be made by dividing the amount of gas in the vessel by the amount of water in the container and converting everything to standard conditions. Although it is preferable, where possible, to route the entire produced volume through the pail, it is not always possible, so a partial stream can be diverted through it. Generally, the results from a partial stream and a full stream are consistent, but the inventor has observed that on occasion, the results are somewhat different. So, a full stream through the bucket may be recommended.

The other facility that may be convenient is a separation barrel with orifice flow tester and water meter. This is a more robust, but somewhat less transportable, separator that can be constructed from a 55-gallon drum. Again a riser pipe through which the produced fluids will flow may be mounted and sealed so that the top of the riser pipe is located about halfway to the top of the drum. A sight glass may be installed so that the level of fluid coming into the drum can be maintained constant by controlling a drain valve located near the bottom of the drum. At the top, an orifice well tester may be located in the opening of the drum. Conditions may be allowed to stabilize and then the water rate may be determined by any means (e.g. flow meters, measured volumes per unit of time), and the gas rate may be determined through the orifice well tester. The ratio of the gas rate to the water rate may then be converted to standard conditions giving the producing gas-water ratio.

Regardless of the separation facility employed, it may or may not be desirable to account for the amount of gas remaining in solution in the water at atmospheric conditions. It may be desirable if extreme accuracy is desired or warranted or at very low bubble points approaching atmospheric pressure. Usually, the amount of solution gas contained in water is represented as a function of absolute pressure. The solution gas-water ratio of this remaining gas can be added to the value determined above, if deemed significant in any application before the next step is performed. If this is done, temperature of the water in the separator and atmospheric pressure may also be recorded at the site of the measurement. The value of this small amount of remaining gas can then be estimated using measured data from a laboratory, Henry's law, or correlations as are discussed throughout this document and particularly in the written description below. In most applications adding in this small amount of gas remaining in solution at atmospheric conditions, while theoretically important, may not be practically important and may beg the accuracy.

In another embodiment, the invention can involve a determination of the bubble point pressure for the formation water of the reservoir. In the event that a bottom-hole sample of formation water is collected and analyzed and if part of the analysis was to determine the bubble point pressure of the formation water at formation temperature and pressure, then for the specific well from which the bottom-hole sample was taken, an embodiment of the present invention may skip determining the solution gas-water ratio and may go directly to determining CDP from the bubble point value. In fact the present invention has discovered that the value of the bubble point pressure of the formation water can be equated to the CDP of the coal.

The bubble point pressure of the formation water can also be estimated by a variety of techniques in accordance with the present invention. If a bottom-hole sample was collected and analyzed, and if the solution gas-water ratio as a function of absolute pressure was obtained as part of the analysis, then the bubble-point pressure of the formation water can be determined by finding the inverse of the functional relationship, with the estimate of solution gas-water ratio as previously described. Mathematically, this can be expressed as, $$bp=f^{-1}(R_{sw}),$$

where bp is bubble point pressure of the formation water and $R_{sw}$ is the solution gas-water ratio. More practically, one can find the bubble point pressure of the formation water from the point on the horizontal axis (bubble point pressure) corresponding to the point where the value of the determined solution gas-water ratio intersects a curve drawn through the experimentally measured data. Anticipated curve shapes can also be used. FIG. 1 shows a fictitious relationship between solution gas-water ratio and bubble point pressure such as might be determined in the laboratory at a given temperature and salinity. One enters the vertical axis at a point (arbitrarily shown as [1]) with the solution gas-water ratio, goes horizontally until one reaches point [2], the intersection point with the curve, and then moves vertically downward to determine the corresponding bubble point pressure of the formation water at point [3]. In doing so, one is implicitly assuming that the water to which a solution gas-water ratio is determined is not appreciably dissimilar from the water analyzed in the laboratory (e.g., same temperature with similar salt concentration, gas composition, etc.). In most cases, this will be a reasonable assumption over fairly large geographical areas within a certain formation in a given geological province. If it is believed that this assumption is not being met, then one risks some accuracy. In such cases, one could have additional samples taken and analyzed. As a somewhat less accurate alternative, water samples from nearby producing wells can be quite easily obtained and sent to a laboratory where a relatively inexpensive and routine analysis can yield salt concentration in the water. In many instances, such measurements are required by state agencies anyway, so the data may be as close as the well file. Also, temperatures of the formations can be readily obtained for a given area from correlations with depth using an appropriate geothermal gradient or by direct measurement. Knowing this range of salt concentrations and temperatures, one could request that the laboratory prepare a family of curves similar to FIG. 1 using this range as bounding values. Then, one could determine the bubble-point pressure by using the appropriate curve or interpolated value between bounding curves corresponding to the temperature of the formation and salt concentration of the formation water from the well for which the bubble point pressure is desired.

While the laboratory-derived curve(s) as discussed in the preceding technique has (have) the advantage of using gases that may be close to the composition of the gas contained in solution of any reservoir of interest and while the formation water can have the correct salinity factors, obtaining such samples and analyses can require time and additional expense. Taking this into consideration and realizing that CBM is mostly methane, probably the preferred technique of determining bubble-point pressure of the formation water is to assume that the gas is all methane and to use existing correlations if reservoir temperatures and pressures are within the specified ranges of the correlation. If reservoir temperatures and pressures are outside of the ranges of the correlation, then according to the present invention extrapolated values of fits to these existing correlations can be used. These correlations are quite prevalent in the literature. For a fairly complete review of these correlations, see Whitson and Brule, 2000, Chapter 9. Two such correlations are particularly appropriate to some embodiments of the present invention: the McCain correlation (McCain, 1991, Equations 52–56) and the Amirijafari and Campbell correlation (Amirijafari and Campbell, 1972).

The McCain correlation fits an original graphical and frequently referenced correlation (see Culberson and McKetta, 1951) with a quadratic equation as a function of absolute pressure and with coefficients that are functions of temperature in degrees Fahrenheit. The correlation is believed accurate to within 5% for the graphical values over pressures from 1,000 psia to 10,000 psia and temperatures from 100 to 340 degrees Fahrenheit. Lending to the nonobvious character if the present invention, McCain himself states that the correlation should not be used for pressures below 1000 psia. Noteworthy is the fact that McCain also provides an equation (Equation 57) that takes into consideration salinity of the formation water. In general, solution-gas decreases with increasing salinity. Whether use with or without the salinity factor, the present invention shows that the McCain correlation can in fact be used in conjunction with or as part of the present invention to achieve the evaluation even though at pressures outside of the recommended range.

Figure 2:
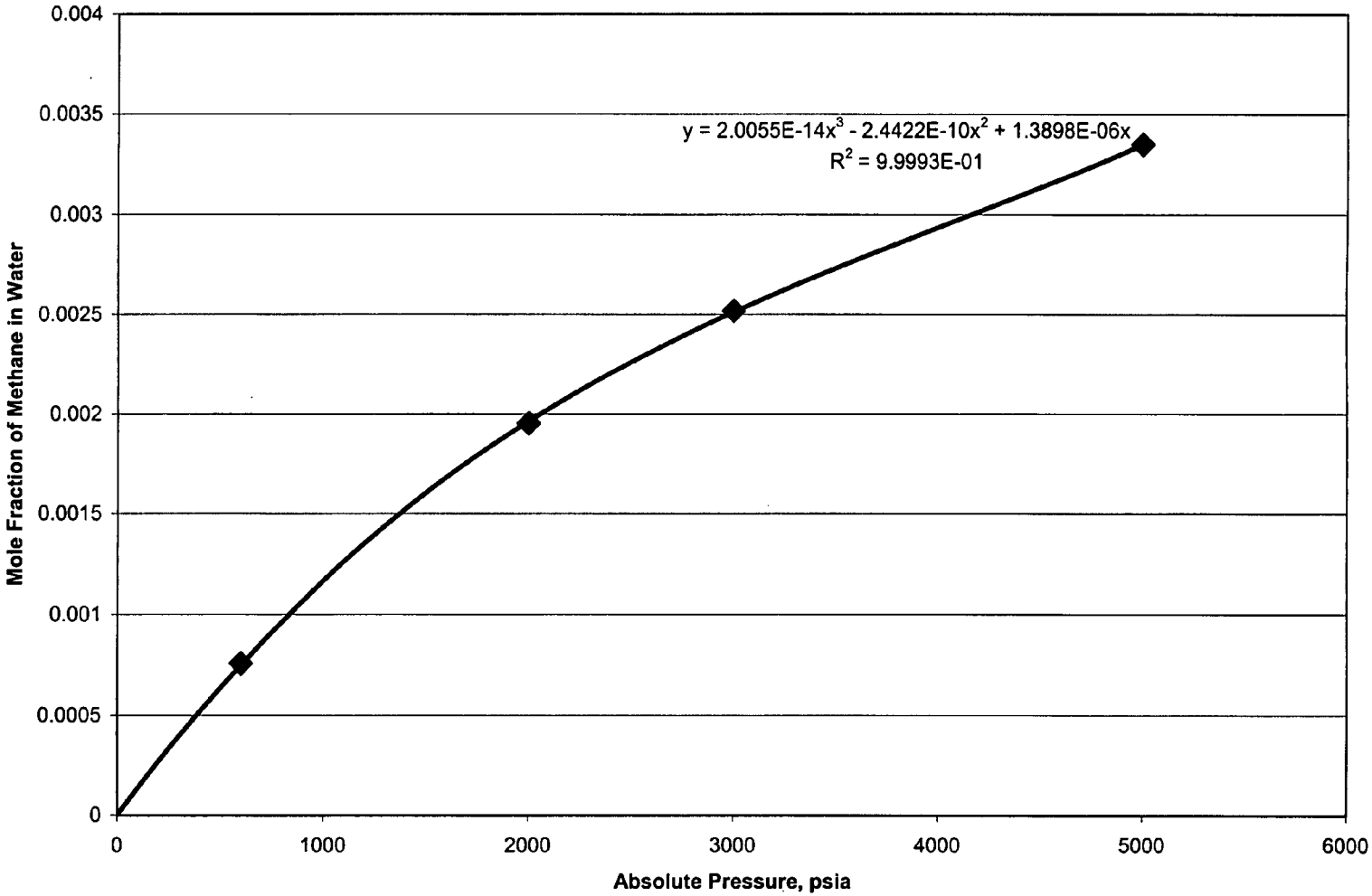
FIG. 2 shows a statistical fit by cubic equation of measured data-representing the solubility of pure methane in water (mole fraction of methane in the water-rich phase) at a temperature of 100 degrees Fahrenheit with extrapolation to zero mole fraction at zero pressure.
Figure 3:
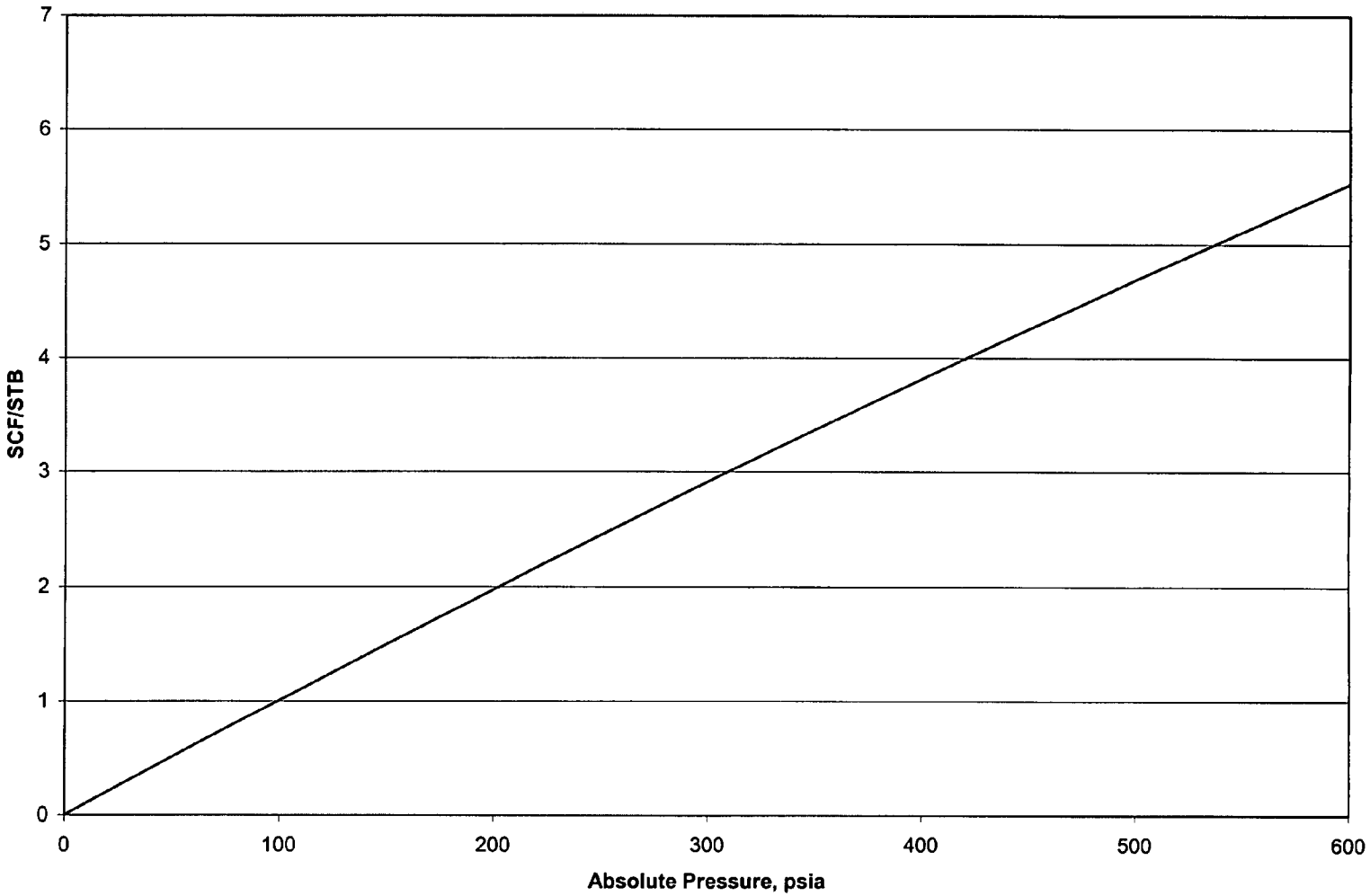
FIG. 3 shows the extrapolation at pressures below 600 psia after conversion to units of SCF/STB of the data of FIG. 2.

The second correlation that can be beneficially used is that of Amirijafari and Campbell (Amirijafari and Campbell, 1972). This includes data at a somewhat lower pressure, but still not at the pressures low enough to address the needs of the present invention. FIG. 2 shows a plot derived from individual data points presented by Amirijafari and Campbell. This data represents the solubility of pure methane in water (mole fraction of methane in the water-rich phase) at a temperature of 100 degrees Fahrenheit and for pressures between 600 and 5000 psia. In accordance with the present invention, a curve has been generated through the data that is a statistical fit by a cubic equation as a function of pressure with the intercept forced to be zero (the equation and goodness of fit are shown in FIG. 2). Since this data begins at 600 psia, use of this correlation also involves extrapolation beyond the values of the data presented. One such extrapolation is shown in FIG. 3 with conversion of mole fraction to units of SCF/STB as supported by the reference to Whitson and Brule, 2000. The significance of the extrapolation can be understood by the fact that in the Powder River Basin, where the invention taught here has been reduced to practice, all bubble points estimated by the invention were below 600 psia. The extrapolation, therefore, has been used and is valuable to estimate the bubble point of the formation water. While normally one extrapolates data outside of its measured range at some risk to accuracy, the invention involves techniques that can reduce the potential inaccuracies of an extrapolation. In embodiments, it may involve the technique of utilizing an expected zero crossing point where, at an absolute pressure of zero, no methane is assumed to remain in solution. It can be noted that by forcing the curve to go through zero-zero, the fit of the curve through the measured points is excellent (See FIG. 2). In addition, there are theoretical methods that can to some degree corroborate the results shown here. Actual data also shows that this embodiment is fairly accurate. In the Powder River Basin this embodiment has been tested in several wells by the inventor exclusively using the extrapolation in spite of the fact that it is outside the range of the measured data, in spite of the fact that the temperatures of the reservoir are typically less than 100 degrees Fahrenheit, in spite of the fact that the formation waters of the PRB are not completely fresh, and in spite of the fact that the gas composition is not entirely methane. In the wells where the reservoir pressure has now dropped to a level where commercial quantities of CBM are now being produced, using the bubble point determined in this manner has resulted in a reliable prediction of CDP. Also, in wells using this technique of bubble point testing in determining CDP, and, in turn, using the determined CDP to estimate gas content has provided a reliable estimate of the gas content of the coal in wells where gas content was measured on cores according to the more expensive and time consuming prior techniques.

Figure 4:
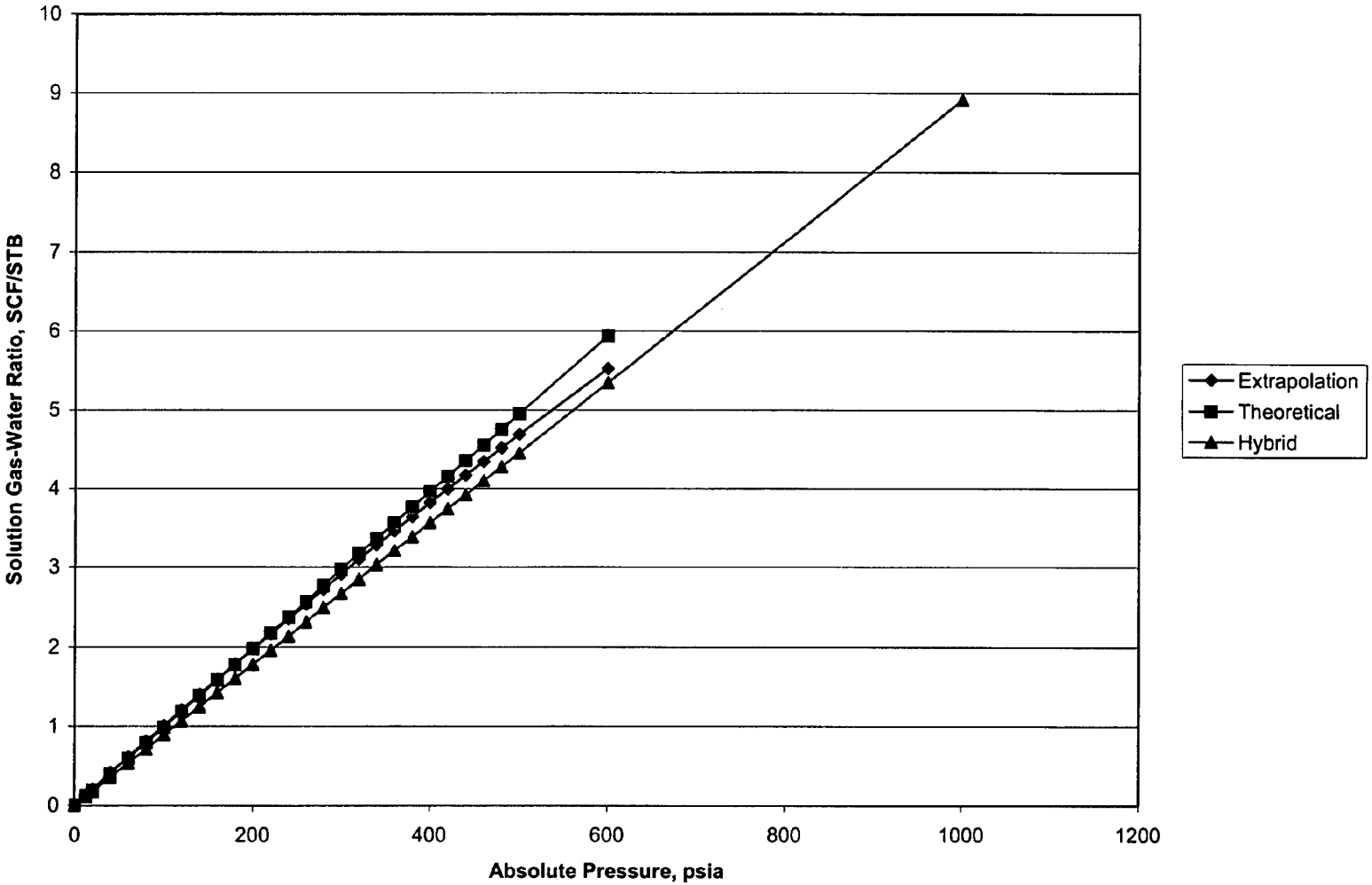
FIG. 4 shows a comparison of three prediction models for the solution gas-water ratio at lower pressures: one based on a theoretical model, one using extrapolation of public data, and one applying a linear extrapolation to publicly available salinity factored data referred to as Hybrid.

A third method of correlation that can be beneficially used is that of theoretical techniques. Estimates of solubility of gas in water for dilute solutions can be determined by theoretical methods. These are also discussed in the reference to Whitson and Brule, 2000 hereby incorporated by reference. FIG. 4 shows the comparison of the solution gas-water ratio predicted by one of these methods, a theoretical methods based on Henry's Law, with the extrapolation of the fit to publicly available data (an Amirijafari and Campbell correlation) and a hybrid method discussed below. The closeness of the curve generated by Henry's Law and the curve from the extrapolation of Amirijafari's and Campbell's data is quite remarkable at pressures below 500 psia—pressures previously thought to be outside the usable range of the data. Note that as pressure increases, the solution becomes less dilute and the theoretical prediction resulting from Henry's law eventually begins to deviate significantly from the measured data. This is consistent with the theory of Henry's law. But in areas of lower pressures, regions where the predicted CDP's fall below 500 psia, this method may have the most utility of all. In fact its value may be understood by the facts that Henry's Law is simple to apply and the fact that Henry's Law constants are readily available in the literature for a wide range of temperatures (e.g., Perry and Green, 1997). When theoretical methods such as these are employed, one can even reduce gas content calculations to a single equation as a function of the solution gas-water ratio as determined above. For example, through the present invention and for a given temperature, one could obtain, by interpolation if need be, the appropriate Henry's law constant, adjust this constant to the appropriate units, solve for pressure as a function of solution gas-water ratio and then substitute this expression into the Langmuir equation resulting in an expression relating gas content directly calculable as a function of one variable, the solution gas-water ratio.

Yet another embodiment may involve the use of an approximate correlation. In particular, it should be understood that any combination of the above theoretical and empirical correlations could be used. For example, Henry's Law may be viewed as resulting in a straight line relationship between solution gas-water ratio and absolute pressure and McCain's correlation may be understood as valid only as low as 1000 psia, it can also be understood that these may not take into account salinity. Even in a salinity based correlation, the inventive technique of utilizing an expected zero crossing point where, at an absolute pressure of zero, no methane is assumed to remain in solution can be applied with success. Specifically, if salinity is deemed an important consideration, one could combine these ideas by evaluating the McCain correlation adjusted for salinity at the edge of the range of applicability of the correlation and then use an equation of a straight line connecting this point running through the origin. Applying this procedure with a salinity of zero results in the curve such as shown in FIG. 4 and identified in the legend as the "Hybrid (McCain endpoint)" method. This, too, can be used in embodiments of the present invention.

A significant aspect of the present invention is its realization that the bubble point pressure of an entirely different substance, namely the formation water, can be used to inductively quantify the critical desorption pressure of the coal. As discussed above, there appears to be no clear recognition that the bubble point pressure of the formation water can be equated to and is the same as the critical desorption pressure of the coal. Perhaps surprisingly, the present inventor has demonstrated that the bubble point pressure of the formation water is the critical desorption pressure of the coal. This fundamental realization permits the easy determination of the CDP and its use several applications of much value.

Figure 5:
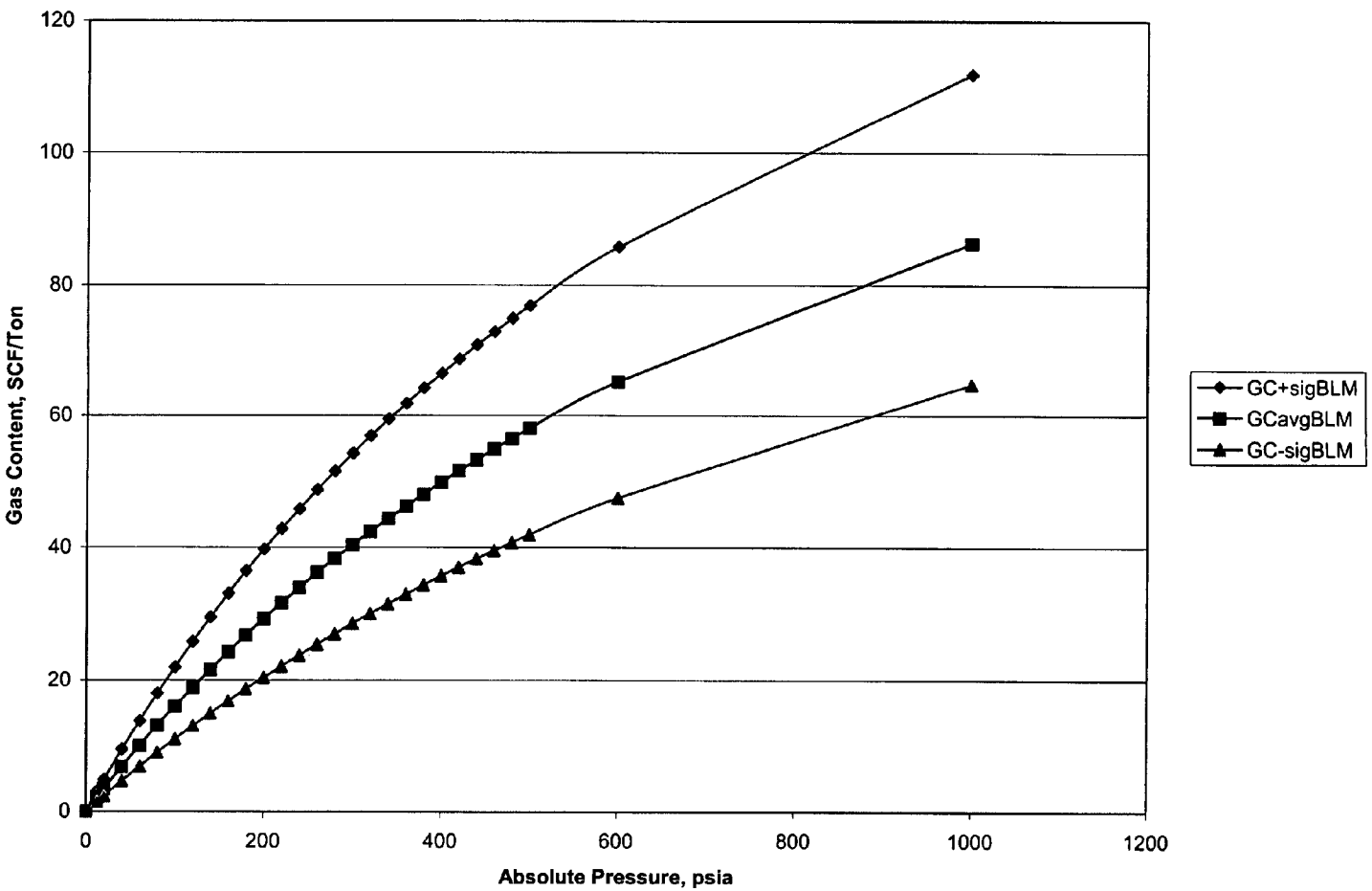
FIG. 5 shows approximate fits of the Langmuir equation with the statistical uncertainty values for the isotherms determined by the BLM for the PRB.

Perhaps of most economic importance, by the highly simplified determination of CDP, gas content can be more easily determined. One of the most valuable applications is to determine CDP by the invention as taught here and then use the value obtained to estimate gas content of the coal. In one embodiment, this gas content can be estimated by using publicly available, predetermined isotherm data. In most coals where CBM deposits are of commercial interest, some evaluation of the deposits has been performed by government agencies holding interest in the deposits. As part of that evaluation, gas contents and isotherms are usually measured and available to the public. As mentioned above, such is the case in the PRB where the BLM has constructed an average synthesized isotherm from isotherms measured on some 40 samples. FIG. 5, prepared by the inventor, shows approximate fits of the Langmuir equation to the isotherms determined by the BLM. The Langmuir equations were found by extracting two points from the curves and determining the Langmuir volume and pressure by algebra. To obtain an estimate of expected gas content using this embodiment, one may simply enter the curve with the CDP on the horizontal curve and determine the value of the gas content from the vertical axis corresponding to the value of CDP from the middle curve, i.e. GC=f(CDP), where GC is gas content. Also, as alluded to above, the BLM has reflected in their figures the uncertainty associated with the data by showing the curves representative of one standard deviation above and below the mean. These have also been approximately fit by using two points by the inventor with the Langmuir equation. From the curves, it is obvious that as the CDP becomes smaller the absolute error becomes smaller so that at very low CDP's, one can even expect, with very little risk, that little gas will be ultimately recoverable. So, if a low CDP, close to zero, is determined by the invention taught here, the prospect for gas recovery from the coal may be viewed as almost nil. For example, using the BLM average isotherm with the CDP determined by the invention taught here and using the Amirijafari and Campbell curve in FIG. 4 resulted in estimates of gas contents for two wells in the PRB of 5.2 and 8.1 SCF/Ton. For the conditions in these wells (including high initial reservoir pressure and low CDP implying long dewatering periods), such values show rather easily that these two wells are not likely prospects for commercial CBM production.

Figure 6:
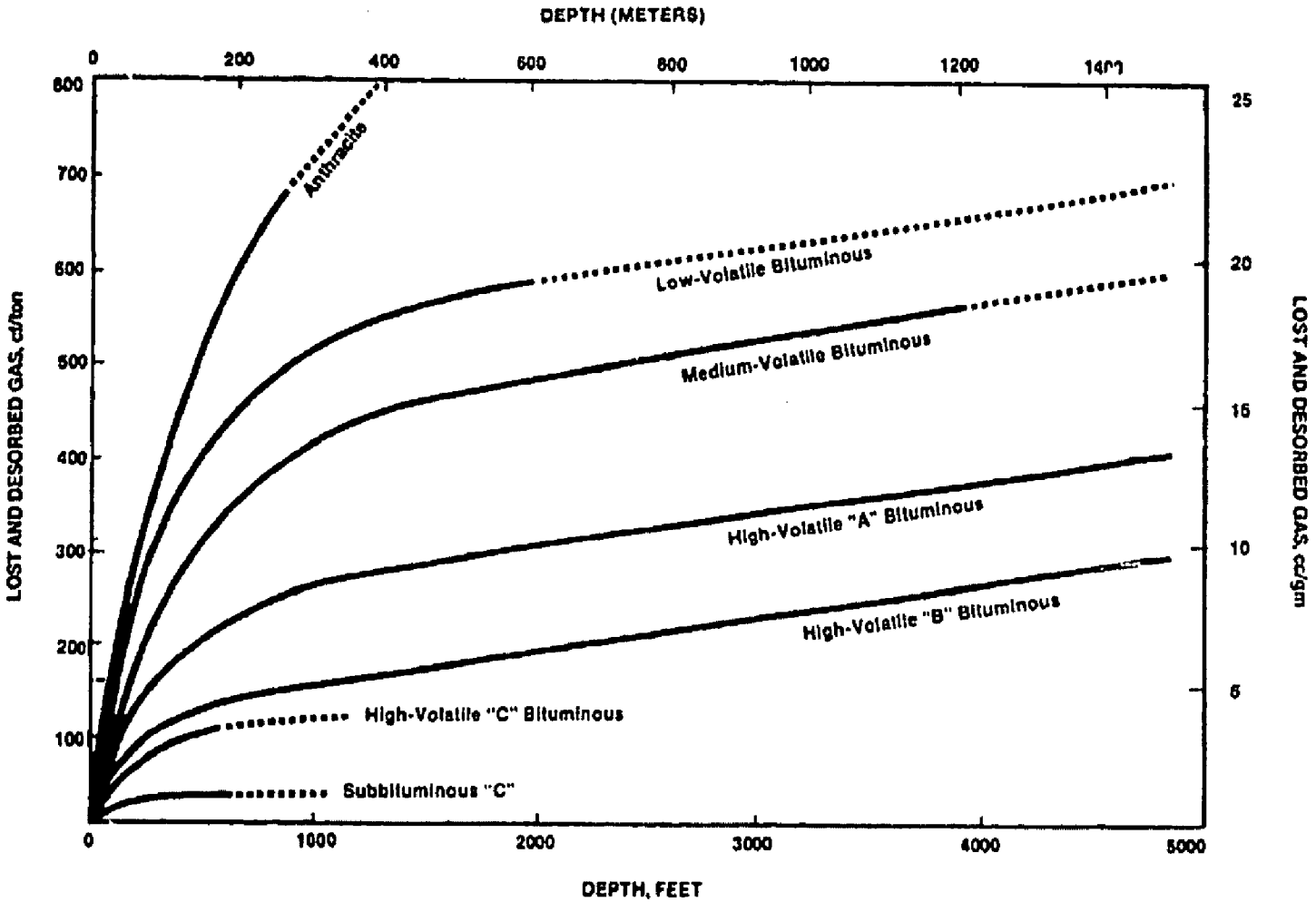
FIG. 6 is a set of publicly available curves that show the relationship between maximum producible methane and depth of coal with rank of the coal as a parameter.
Figure 7:
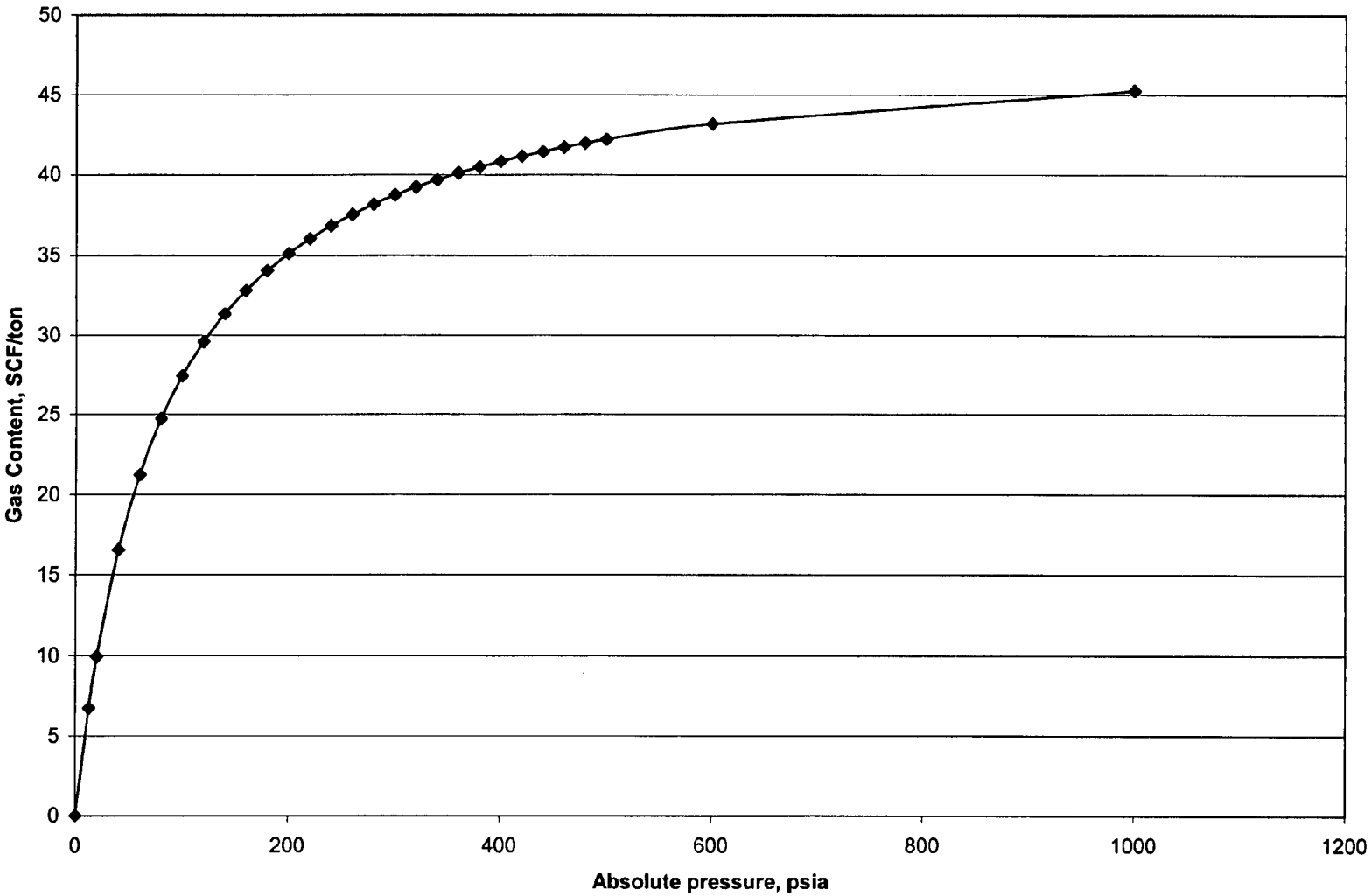
FIG. 7 is an isotherm constructed in accordance with the present invention based upon the above curve for subbituminous C coals.

In another embodiment, this gas content can also be estimated by using correlations based on rank of coal using coal-type ranked data. A published set of curves such as shown in FIG. 6 that show the relationship between maximum producible methane and depth of coal with rank of the coal as a parameter can be used in this embodiment (see Eddy et al, 1982). As a first approximation, one could convert these curves to functions of absolute pressure by assuming a fresh-water, hydrostatic gradient (0.433 psi/ft), multiplying this number by the depth, and by adding atmospheric pressure to the result. As such, these would then represent an inexpensive isotherm that could be used to estimate gas content if the rank of the coal is known. For example, in the PRB, the gas-containing coal is predominantly, if not exclusively, subbituminous in rank. Constructing an isotherm according to the present invention with use of Eddy's curve for subbituminous C coals results in FIG. 7. In practice, the plot in FIG. 7 was constructed by pulling two points off the graph of FIG. 6, converting the abscissa to psia and determining the Langmuir volume and pressure from simultaneous solution of the equation of these two unknowns. Making this embodiment less intuitive is the fact that the plot of FIG. 6, as will be noted, for such low gas-content coals could result in highly subjective interpretations. With no particular attempt to fit the data, however, the gas contents resulting from the use of this isotherm embodiment and the invention embodiment turned out to be 13.7 and 18.7 SCF/ton—which compare respectively to the ones determined in the preceding paragraph. While the two sources of isotherms may appear to give results that are significantly different, in the PRB where the range of gas contents can be 0 to 100+SCF/ton, both of these results would likely result in the same conclusion, i.e. that the coals in these wells have gas contents on the low end of the range for the PRB. Also, it can be noted that the approach using coal rank to generate the isotherm will also allow one to make the conclusion that the second coal is relatively better than the first and this could be valuable to know as explained next.

In yet a further embodiment, merely relative gas content can be estimated even if the only thing that is known in a given area is an approximate gas content at a given pressure, in such an embodiment, a fictitious isotherm could be constructed just by sketching in an arbitrary shape, with use of the technique of going through the given pressure and the origin of zero gas content at zero absolute pressure. For example, a source for such data might be a well where gas contents had been measured in a laboratory, but the operator may not have requested that an isotherm be measured as part of the laboratory measurements. Associating the measured gas content with the CDP determined by the invention taught here could help in defining the fictitious isotherm with increased accuracy by requiring it to go through this one measured point. Carrying this approach one step further, if there happened to be yet another well in close proximity where another gas content measurement had been determined and also a CDP determination made by the invention taught here, then, if the gas content and CDP were uniquely different from the first, one could construct an isotherm that could conceivably be better than the one determined with only a single point. In some embodiments, two non-zero points may be all that are required to adequately define an isotherm. In these manners, determining CDP for a number of exploratory wells in a given geologic area by the invention taught here and estimating the gas content using the fictitious isotherm could then provide a relative ranking of prospects for development with those having the highest gas contents having the highest rank. Similarly, even without any gas contents measured at all, if the CDP's were measured on a number of exploratory wells using the invention taught here in a given geologic area, just arranging the measured CDP's in order of highest to lowest CDP could give a working list of developmental prospects with those having the highest CDP's being developed first.

Table 1 shows a number of comparisons between the uses of the various techniques of determining gas contents using the methodology discussed above and the invention taught here to determine CDP. Merely as a point of reference, Table 1 also shows results from gas contents determined from cores for the two wells in the PRB. As discussed above, the core-measured data should not necessarily be regarded as the truth because of the inherent problems associated with its estimation. Nevertheless, the results show that the invention as taught here can provide remarkable consistency with measured data from cores but at a drastically reduced expense—particularly when data, like the BLM data is available for a given region. As mentioned, at higher CDP's the error in the approximation for gas content may increase. In spite of this, the inventor has noted, however, that the predicted CDP at higher resulting values of CDP using the invention taught here and the BLM average curve was an accurate predictor of the reservoir pressure when the wells subsequently started producing gas. Gas contents determined by using the average BLM isotherm and the invention taught here to determine CDP's have resulted in estimates of gas contents from zero to 60 SCF/ton in about 20 wells where the method has been applied.

As should be understood from the above, the embodiments relative to the characterization of the reservoir or even the determination of gas content in accordance with the present invention can be highly varied. One may simply involve a prediction of how much drop in reservoir pressure is likely to be required by dewatering before gas is produced. Once the CDP is estimated by the invention taught here and with a measurement of initial pressure of the reservoir, an estimate can be determined of how much water must be produced before commercial quantities of gas can be produced, an estimated dewatering value. This may be done by approximate reservoir engineering calculations, or in more sophisticated calculations, by a reservoir simulator. Obviously having to dewater for long periods of time without producing any gas can be a major detriment to positive economics of any project under consideration.

Another embodiment may involve a determination of current saturation character or saturation state of a coal used for gas storage or sequestration of harmful greenhouse gases like carbon dioxide. By using the invention taught here and an isotherm or multi-component isotherm representative of the gas(es) being stored or sequestered in an undersaturated coal, one could estimate the current saturation state of the coal. This could be valuable so that an estimate could be made as to when the storage reservoir would effectively be filled up (i.e. when it would become saturated). Similarly the invention as taught here could be used in determining the saturation state of the formation after a period of injection of displacing gases such as are used in Enhanced Coalbed Methane (ECBM) recovery processes (Puri and Stein, 1989).

Challenging situations can also be addressed in some embodiments. For example, in reservoirs with low permeability or low permeability wells, an issue may arise respective of produced wells. In the immediate vicinity of the wellbore, the reservoir pressure could be very low from producing at low bottom hole pressure. The reservoir pressure usually increases very rapidly away from the wellbore due to the typical pressure profile associated with radial flow. It is possible that a portion of the reservoir near the well could have been drawn below a CDP of the coal, for a period long enough to de-gas to a certain degree. Detecting when de-gassing is occurring may be desirable and, if not adequately accounted for, can be missed. In time, de-gassing could deplete the coal in the immediate vicinity of the well. If the well is shut-in long enough for the water and the coal to equilibrate, a determined CDP may be artificially low. The determined CDP may not be representative of the CDP of the bulk of the coal some distance away from the wellbore. With time, natural or induced groundwater flow may resaturate the coal to at or near a CDP, such as a CDP prior to production; but if, for example, the formation is 'tight' so as to prevent much groundwater flow, such as may be due to typically small gradients, and also if the period of shut-in is long, then a measured CDP may not be representative of the CDP of the coal of the reservoir, as may be the case when the well is returned to production potentially for testing. Embodiments of the present invention may be use to address unrepresentative CDP determinations. Accordingly, as features of some embodiments, producing a well at small drawdown for a period of time (perhaps a week, or a producing period that may be otherwise longer than a traditionally expected production) after a period of quiescence or non-production may be used. Water coming from the bulk of the formation will likely be moving rapidly through the volume immediately next to the wellbore and what little CBM that may be lost to the highly undersaturated coal immediately near the wellbore may not significantly impact the determinations of the present invention and may even be ignored. Eventually, the coal near the wellbore will resaturate to at or near an original CDP allowing equilibrium methane conditions to be established at the well bottom; but in accordance with the present invention, it may not be necessary to wait until full resaturation occurs before testing. Furthermore, and if desired, several tests could be conducted with time until the CDP stops increasing and in a manner that affirmatively allows pressure to rebuild, not mere have it happen incidentally.

Yet another embodiment relative to the characterization of the reservoir in accordance with the present invention may be the determination of the economic viability of continuing to produce water from existing producers, more generally the inclusion of an economic factor in the characterization. Many existing production wells have been producing water for years with the operators not knowing whether these wells will ever produce economic quantities of CBM. Threshold values or, more generally, screening criteria can be used that incorporate a variety of concerns into an economic viability or other analysis, including individually or in concert, but not limited to: a screening criterion based upon a reservoir pressure, a screening criterion based upon a permeability of the reservoir, a screening criterion based upon the apparent critical desorption pressure of coal in the reservoir, a screening criterion based upon the estimated dewatering needs of the reservoir, a screening criterion based upon the degree of undersaturation of the coal in the reservoir, a screening criterion based upon current or projected prices of gas, and even a set value of gas content. These may also be particularly suited to computer analysis or automated modalities and may be used not just for producers, but for leaseholders, bankers or other persons interested in the productive capabilities or in the valuation of a particular property. The invention taught here can also be used with existing producers that have yet to produce commercial quantities of CBM.

In one embodiment of the present invention, a single production test of the well can be accomplished in usually less than one day and immediately if the well has been produced for some period ahead of testing (e.g. a producing well where the pressure of the reservoir has not dropped below the CDP). Typically, in a new well, one day is sufficient for the well to displace foreign fluids introduced during drilling and completion and to produce a stream of water representative of the formation water, but if not, the well can be run until the solution gas-water ratio becomes relatively constant with repeated measurements. Thus, the invention may lead to a quicker determination of CDP than could be obtained from coring methods and analysis. In turn, the CDP obtained by applying the invention taught here can be used in conjunction with representative isotherms of the area being investigated to make an accurate and quick determination of gas content of the coal relative to the months that coring and core analysis might take to arrive at the same result.

In applying the present invention, it may be noted that results may even be more objectively reliable than a localized testing methodology such as coal sampling since the mixing of the formation water surrounding adjacent coals tends to average out differences normally observed in results obtained by sample selection during coring and removes the subjectivity associated with sample selection in core analysis. The results may also be more reliable because the formation water is coming primarily from the same coal that will ultimately be the gas-productive coal.

In addition, the present invention can address the problem identified above where multiple wells must be drilled in a pilot. This can even be eliminated because when the invention taught here is employed, the same information can be obtained from a short test from a single well or short tests of a few wells thus eliminating millions of dollars in development costs and months, in some cases years, of attempts at dewatering to bring the reservoir pressure below its CDP so that gas can be produced in commercial quantities and a determination made of the value of the resource.

When the invention taught here is employed, a good estimate can be made of the existing gas content of the reservoir thus allowing an economic evaluation of the coal immediately after the well is drilled or, in one application, even while the well is being drilled and an informed decision can be made regarding whether additional development wells should be drilled.

When the invention taught here is used, one may not have to worry about the state of equilibrium of the fluids in the borehole because the invention taught here can provide a way of checking to see if the fluid being tested is representative of formation water.

Additionally it should be understood that any of the above methods can be embodied and encoded in a computer program to further simplify and to some degree even automate the evaluation methods employed. It also may comprise a sampling apparatus performing any or all of the above aspects as well as the products produced by any or all of these aspects.

As can be easily understood from the foregoing, the basic concepts of the present invention may be embodied in a variety of ways. It involves both determination, evaluation, and characterization techniques as well as systems, plurality of apparatus, assemblies, and devices to accomplish the appropriate determination, evaluation, and characterization. In this application, the techniques are disclosed as part of the results shown to be achieved by the various methods. Devices may be encompassed that perform any of these as well. While some methods are disclosed, it should be understood that these may be accomplished by certain devices and can also be varied in a number of ways. Importantly, as to all of the foregoing, all of these facets should be understood to be encompassed by this disclosure.

The discussion included in patent is intended to serve as a basic description. The reader should be aware that the specific discussion may not explicitly describe all embodiments possible; many alternatives are implicit. It also may not fully explain the broad nature of the invention and may not explicitly show how each feature or element can actually be representative of a broader function or of a great variety of alternative or equivalent elements. Again, these are implicitly included in this disclosure. Where the invention is described in method-oriented terminology, each step may be performed by a device, component, or element. Apparatus claims may also be included for the methods described. Neither the description nor the terminology is intended to limit the scope of the claims that will be included in a full patent application.

It should also be understood that a variety of changes may be made without departing from the essence of the invention. Such changes are also implicitly included in the description. They still fall within the scope of this invention. It should be understood that this disclosure is intended to yield a patent covering numerous aspects of the invention both independently and as an overall system and in both method and apparatus modes.

Further, each of the various elements of the invention and claims may also be achieved in a variety of manners. This disclosure should be understood to encompass each such variation, be it a variation of an embodiment of any apparatus embodiment, a method or process embodiment, or even merely a variation of any element of these. Particularly, it should be understood that as the disclosure relates to elements of the invention, the words for each element may be expressed by equivalent apparatus terms or method terms—even if only the function or result is the same. Such equivalent, broader, or even more generic terms should be considered to be encompassed in the description of each element or action. Such terms can be substituted where desired to make explicit the implicitly broad coverage to which this invention is entitled. It should be understood that all actions may be expressed as a means for taking that action or as an element which causes that action. Similarly, each physical element disclosed should be understood to encompass a disclosure of the action which that physical element facilitates. Regarding this last aspect, as but one example, the disclosure of "separation facilities" should be understood to encompass disclosure of the act of "separating"—whether explicitly discussed or not—and, conversely, where there is disclosure of the act of "separating", such a disclosure should be understood to encompass disclosure of a "separation facility" and even a "means for separating." Such changes and alternative terms are to be understood to be explicitly included in the description.

Any patents, publications, or other references mentioned in this application for patent are hereby incorporated by reference. In addition, as to each term used it should be understood that unless its utilization in this application is inconsistent with such interpretation, common dictionary definitions should be understood as incorporated for each term and all definitions, alternative terms, and synonyms such as contained in the Random House Webster's Unabridged Dictionary, second edition are hereby incorporated by reference. Finally, all references listed in the Information Disclosure Statement or other information statement filed with the application are hereby appended and hereby incorporated by reference; however, as to each of the above, to the extent that such information or statements incorporated by reference might be considered inconsistent with the patenting of this/these invention(s), such statements are expressly not to be considered as made by the applicant(s).

Thus, the applicant should be understood to have support to claim at least: i) each of the determination, characterization, and evaluation systems, plurality of apparatus, assemblies, and devices as herein disclosed and described, ii) the related processes and methods disclosed and described, iii) similar, equivalent, and even implicit variations of each of these systems, plurality of apparatus, assemblies, and devices, processes and methods, iv) those alternative designs which accomplish each of the functions shown as are disclosed and described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) methods and systems, plurality of apparatus, assemblies, and devices substantially as described hereinbefore and with reference to any of the accompanying examples, x) the various combinations and permutations of each of the elements disclosed, xi) each potentially dependent claim or concept as a dependency on each and every one of the independent claims or concepts presented, xii) processes performed with the aid of or on a computer as described throughout the above discussion, xiii) a programmable apparatus as described throughout the above discussion, xiv) a computer readable memory encoded with data to direct a computer comprising means or elements which function as described throughout the above discussion, xv) a computer configured as herein disclosed and described, xvi) individual or combined subroutines and programs as herein disclosed and described, xvii) the related methods disclosed and described, xviii) similar, equivalent, and even implicit variations of each of these systems and methods, xix) those alternative designs which accomplish each of the functions shown as are disclosed and described, xx) those alternative designs and methods which accomplish each of the functions shown as are implicit to accomplish that which is disclosed and described, xxi) each feature, component, and step shown as separate and independent inventions, and xxii) the various combinations and permutations of each of the above. In this regard it should be understood that for practical reasons and so as to avoid adding potentially hundreds of claims, the applicant has presented claims with initial dependencies only. Support should be understood to exist to the degree required under new matter laws—including but not limited to United States Patent Law 35 USC 132 or other such laws—to permit the addition of any of the various dependencies or other elements presented under one independent claim or concept as dependencies or elements under any other independent claim or concept.

To the extent that insubstantial substitutes are made, to the extent that the applicant did not in fact draft any claim so as to literally encompass any particular embodiment, and to the extent otherwise applicable, the applicant should not be understood to have in any way intended to or actually relinquished such coverage as the applicant simply may not have been able to anticipate all eventualities; one skilled in the art, should not be reasonably expected to have drafted a claim that would have literally encompassed such alternative embodiments.

Further, the use of the transitional phrase "comprising" is used to maintain the "open-end" claims herein, according to traditional claim interpretation. Thus, unless the context requires otherwise, it should be understood that the term "comprise" or variations such as "comprises" or "comprising", are intended to imply the inclusion of a stated element or step or group of elements or steps but not the exclusion of any other element or step or group of elements or steps. Such terms should be interpreted in their most expansive form so as to afford the applicant the broadest coverage legally permissible.

What is claimed is:

1. A method of calculating a production characteristic for an undersaturated coalbed methane reservoir comprising the steps of:

a. accessing a well admitted to an undersaturated coalbed methane reservoir;

b. sampling formation water from said undersaturated coalbed methane reservoir;

c. conducting a test based on said formation water sample;

d. inductively quantifying a methane content value of sorbed methane that is sorbed in a solid formation substance from said water sample by calculating a transformation to provide a report relating gas content in water to gas content in said coalbed methane reservoir; and e. calculating an economic production characteristic for said coalbed methane reservoir as a result of said transformation; and f. applying said economic production characteristic to calculate and report a practical production quantity for said coalbed methane reservoir.

2. A method of calculating a production characteristic for an undersaturated coalbed methane reservoir as described in claim 1 wherein said step of sampling formation water from said undersaturated coalbed methane reservoir comprises the step of capturing substantially pure formation fluid.

3. A method of calculating a production characteristic for an undersaturated coalbed methane reservoir as described in claim 2 wherein said step of sampling formation water from said undersaturated coalbed methane reservoir further comprises the step of sampling by a downhole device.

4. A method of calculating a production characteristic for an undersaturated coalbed methane reservoir as described in claim 1 wherein said step of sampling formation water from said undersaturated coalbed methane reservoir comprises the step of assuring that said formation water sample is representative of fluid from said undersaturated coalbed methane reservoir.

5. A method of calculating a production characteristic for an undersaturated coalbed methane reservoir as described in claim 4 wherein said step of assuring that said formation water sample is representative of fluid from said undersaturated coalbed methane reservoir comprises the step of producing at least a well pathway volume of fluid.

6. A method of calculating a production characteristic for an undersaturated coalbed methane reservoir as described in claim 4 wherein said step of assuring that said formation water sample is representative of fluid from said undersaturated coalbed methane reservoir comprises the step of producing at least a well tubing volume of fluid.

7. A method of calculating a production characteristic for an undersaturated coalbed methane reservoir as described in claim 4 wherein said well has a well bottom and wherein said step of assuring that said formation water sample is representative of fluid from said undersaturated coalbed methane reservoir comprises the steps of:

a. ceasing production on said well for a period of time; and b. allowing equilibrium methane conditions to be established at said well bottom.

8. A method of calculating a production characteristic for an undersaturated coalbed methane reservoir as described in claim 4 wherein said well has a well bottom, wherein said coalbed methane reservoir has a natural reservoir pressure at said well bottom location, and a well bottom pressure and wherein step of assuring that said formation water sample is representative of fluid from said undersaturated coalbed methane reservoir comprises the step of permitting said well bottom pressure to substantially equal said natural reservoir pressure.

9. A method of calculating a production characteristic for an undersaturated coalbed methane reservoir as described in claim 4 and further comprising the step of determining if said well has a slow production rate, and wherein said step of sampling formation water from said undersaturated coalbed methane reservoir comprises the steps of:

a. permitting an inappropriately low pressure not representative of conditions naturally occurring for said undersaturated coalbed methane reservoir;

b. allowing said undersaturated coalbed methane reservoir to rebuild pressure to a pressure appropriately representative of conditions naturally occurring for said undersaturated coalbed methane reservoir;

c. producing at least one well pathway volume of fluid; and then d. sampling formation water from said undersaturated coalbed methane reservoir.

10. A method of calculating a production characteristic for an undersaturated coalbed methane reservoir as described in claim 1 and further comprising the step of having a constant fluid production from said well at the time of said sampling.

11. A method of calculating a production characteristic for an undersaturated coalbed methane reservoir as described in claim 1 wherein said well has a well bottom and wherein said step of sampling formation water from said undersaturated coalbed methane reservoir comprises the step of collecting a single phase fluid from about said well bottom.

12. A method of calculating a production characteristic for an undersaturated coalbed methane reservoir as described in claim 11 wherein said step of sampling formation water from said undersaturated coalbed methane reservoir further comprises the step of sampling by a downhole device.

13. A method of calculating a production characteristic for an undersaturated coalbed methane reservoir as described in claim 1 wherein said step of sampling formation water from said undersaturated coalbed methane reservoir comprises the step of effecting only a small drawdown.

14. A method of calculating a production characteristic for an undersaturated coalbed methane reservoir as described in claim 13 wherein said step of effecting only a small drawdown comprises the step of effecting only a small drawdown for a long period of time so as to not go below the bubble point pressure of the formation water.

15. A method of calculating a production characteristic for an undersaturated coalbed methane reservoir as described in claim 14 wherein said step of effecting only a small drawdown for a long period of time comprises the step of effecting only a small drawdown for a period of time selected from a group consisting of about one week, several days, about one day, longer than a traditional formation water sampling time.

16. A method of calculating a production characteristic for an undersaturated coalbed methane reservoir as described in claim 13 wherein said step of sampling formation water from said undersaturated coalbed methane reservoir comprises the step of sampling formation water after a period of nonproduction from said well.

17. A method of calculating a production characteristic for an undersaturated coalbed methane reservoir as described in claim 1 wherein said step of sampling formation water from said undersaturated coalbed methane reservoir comprises the step of sampling formation water until a gas-water ratio of said water is constant.

18. A method of calculating a production characteristic for an undersaturated coalbed methane reservoir as described in claim 17 wherein said step of sampling formation water from said undersaturated coalbed methane reservoir further comprises the step of sampling by a downhole device.

19. A method of calculating a production characteristic for an undersaturated coalbed methane reservoir as described in claim 17 wherein said step of sampling formation water until a gas-water ratio of said water is constant comprises the step of determining the solution gas-water ratio of said formation water in situ by a downhole measuring device.

20. A method of calculating a production characteristic for an undersaturated coalbed methane reservoir as described in claim 1 wherein said step of sampling formation water from said undersaturated coalbed methane reservoir comprises the step of contained sampling said formation water.

21. A method of calculating a production characteristic for an undersaturated coalbed methane reservoir as described in claim 20 wherein said step of contained sampling formation water comprises the step of sampling by a downhole device.

22. A method of calculating a production characteristic for an undersaturated coalbed methane reservoir as described in claim 20 wherein said step of contained sampling said formation water comprises the step of uncashed drill stem sampling.

23. A method of calculating a production characteristic for an undersaturated coalbed methane reservoir as described in claim 20 wherein said step of contained sampling said formation water comprises the steps of:

a. Lowering a tool in said well;

b. isolating a sampling area by packing; and c. transporting a sample to a surface in a drill pipe.

24. A method of calculating a production characteristic for an undersaturated coalbed methane reservoir as described in claim 20 wherein said step of accessing a well admitted to an undersaturated coalbed methane reservoir comprises the step of pumping a fluid from said well.

25. A method of calculating a production characteristic for an undersaturated coalbed methane reservoir as described in claim 24 wherein said step of contained sampling said formation water comprises the step of isolating said formation water both before and after it is subjected to said step of pumping a fluid from said well.

26. A method of calculating a production characteristic for an undersaturated coalbed methane reservoir as described in claim 24 wherein said step of pumping a fluid from said well comprises the step of pumping adjacent said undersaturated coalbed methane reservoir.

27. A method of calculating a production characteristic for an undersaturated coalbed methane reservoir as described in claim 24 wherein said step of pumping a fluid from said well comprises the steps of:

a. pumping at a location remote from said undersaturated coalbed methane reservoir; and b. avoiding a phase separation prior to accomplishing said step of pumping a fluid from said well.

28. A method of calculating a production characteristic for an undersaturated coalbed methane reservoir as described in claim 24 wherein said step of sampling formation water from said undersaturated coalbed methane reservoir comprises the step of avoiding a pressure drop below a bubble point of said formation water prior to accomplishing said step of pumping a fluid from said well.

29. A method of calculating a production characteristic for an undersaturated coalbed methane reservoir as described in claim 24 wherein said well has a well bottom and wherein said step of sampling formation water from said undersaturated coalbed methane reservoir comprises the step of maintaining said well bottom at at least a bubble point of said formation water.

30. A method of calculating a production characteristic for an undersaturated coalbed methane reservoir as described in claim 20 wherein said step of contained sampling said formation water comprises the step of contained sampling both formation water and gas from said well at a surface.

31. A method of calculating a production characteristic for an undersaturated coalbed methane reservoir as described in claim 1 wherein said step of conducting a test based on said formation water sample comprises the step of on-site testing of said formation water.

32. A method of calculating a production characteristic for an undersaturated coalbed methane reservoir as described in claim 1 wherein said step of conducting a test based on said formation water sample comprises the step of determining a gas-water ratio of said formation water.

33. A method of calculating a production characteristic for an undersaturated coalbed methane reservoir as described in claim 32 wherein said step of determining a gas-water ratio of said formation water comprises the step of directly testing said gas-water ratio of said formation water.

34. A method of calculating a production characteristic for an undersaturated coalbed methane reservoir as described in claim 33 wherein said step of directly testing said gas-water ratio of said formation water comprises the step of on-site testing of said formation water.

35. A method of calculating a production characteristic for an undersaturated coalbed methane reservoir as described in claim 34 wherein said step of on-site testing of said formation water comprises the step of conducting a surface test of said formation water.

36. A method of calculating a production characteristic for an undersaturated coalbed methane reservoir as described in claim 35 wherein said step of conducting a surface test of said formation water comprises the step of capturing gas from said undersaturated coalbed methane reservoir.

37. A method of calculating a production characteristic for an undersaturated coalbed methane reservoir as described in claim 34 wherein said step of on-site testing of said formation water comprises the step of in situ testing said formation water by a downhole measuring device.

38. A method of calculating a production characteristic for an undersaturated coalbed methane reservoir as described in claim 32 wherein said step of determining a gas-water ratio of said formation water comprises the step of testing the total gas content of said formation water.

39. A method of calculating a production characteristic for an undersaturated coalbed methane reservoir as described in claim 38 wherein said step of testing the total gas content of said formation water comprises the step of determining the solution gas-water ratio of said formation water in situ by a downhole measuring device.

40. A method of calculating a production characteristic for an undersaturated coalbed methane reservoir as described in claim 32 wherein said step of determining a gas-water ratio of said formation water comprises the step of deducing said gas-water ratio of said formation water.

41. A method of calculating a production characteristic for an undersaturated coalbed methane reservoir as described in claim 40 wherein said step of deducing said gas-water ratio of said formation water comprises the steps of:

a. measuring gas factors at a plurality of pressures; and b. creating a curve based at least in part on said step of measuring gas factors at a plurality of pressures.

42. A method of calculating a production characteristic for an undersaturated coalbed methane reservoir as described in claim 32 wherein said step of sampling formation water from said undersaturated coalbed methane reservoir comprises the step of sampling by a downhole device.

43. A method of calculating a production characteristic for an undersaturated coalbed methane reservoir as described in claim 32 wherein said step of determining a gas-water ratio of said formation water comprises the step of determining the solution gas-water ratio of said formation water in situ by a downhole measuring device.

44. A method of calculating a production characteristic for an undersaturated coalbed methane reservoir as described in claim 1 wherein said step of conducting a test based on said formation water sample comprises the step of determining a bubble point of said formation water.

45. A method of calculating a production characteristic for an undersaturated coalbed methane reservoir as described in claim 44 wherein said step of determining a bubble point of said formation water comprises the step of directly testing said bubble point of said formation water.

46. A method of calculating a production characteristic for an undersaturated coalbed methane reservoir as described in claim 45 wherein said step of directly testing said bubble point of said formation water comprises the step of on-site testing of said formation water.

47. A method of calculating a production characteristic for an undersaturated coalbed methane reservoir as described in claim 46 wherein said step of directly testing said bubble point of said formation water comprises the step of conducting a surface test of said formation water.

48. A method of calculating a production characteristic for an undersaturated coalbed methane reservoir as described in claim 47 wherein said step of directly testing said bubble point of said formation water comprises the step of testing said formation water during drilling.

49. A method of calculating a production characteristic for an undersaturated coalbed methane reservoir as described in claim 47 wherein said step of directly testing said bubble point of said formation water comprises the steps of:

a. releasing pressure from a contained volume; and b. observing a change resulting from said release of pressure.

50. A method of calculating a production characteristic for an undersaturated coalbed methane reservoir as described in claim 49 wherein said step of sampling formation water from said undersaturated coalbed methane reservoir comprises the step of contained sampling said formation water.

51. A method of calculating a production characteristic for an undersaturated coalbed methane reservoir as described in claim 46 wherein said step of directly testing said bubble point of said formation water comprises the step of acoustically testing.

52. A method of calculating a production characteristic for an undersaturated coalbed methane reservoir as described in claim 46 wherein said step of directly testing said bubble point of said formation water comprises the step of sensing a differential pressure drop.

53. A method of calculating a production characteristic for an undersaturated coalbed methane reservoir as described in claim 46 wherein said step of on-site testing of said formation water comprises the step of in situ testing said formation water by a downhole measuring device.

54. A method of calculating a production characteristic for an undersaturated coalbed methane reservoir as described in claim 44 wherein said step of inductively quantifying a methane content characteristic of sorbed methane that is sorbed in a solid formation substance from said water sample comprises the step of using a bubble point of said formation water to imply a critical desorption pressure of said undersaturated coalbed methane reservoir.

55. A method of calculating a production characteristic for an undersaturated coalbed methane reservoir as described in claim 44 wherein said step of determining a bubble point of said formation water comprises the step of assuming all gas sorbed in said formation water is methane.

56. A method of calculating a production characteristic for an undersaturated coalbed methane reservoir as described in claim 44 wherein said step of determining a bubble point of said formation water comprises the step of directly testing said bubble point of said formation water.

57. A method of calculating a production characteristic for an undersaturated coalbed methane reservoir as described in claim 44 wherein said step of determining a bubble point of said formation water comprises the step of deducing said bubble point of said formation water.

58. A method of calculating a production characteristic for an undersaturated coalbed methane reservoir as described in claim 57 wherein said step of deducing said bubble point of said formation water comprises the steps of:

a. measuring gas factors at a plurality of pressures; and b. creating a curve based at least in part on said step of measuring gas factors at a plurality of pressures.

59. A method of calculating a production characteristic for an undersaturated coalbed methane reservoir as described in claim 58 wherein said step of deducing said bubble point of said formation water further comprises the step of accomplishing a curve fitting function to a given set of data points.

60. A method of calculating a production characteristic for an undersaturated coalbed methane reservoir as described in claim 59 wherein said step of accomplishing a curve fitting function to a given set of data points comprises the step of utilizing a cubic equation.

61. A method of calculating a production characteristic for an undersaturated coalbed methane reservoir as described in claim 57 wherein said step of deducing said bubble point of said formation water comprises the step of utilizing publicly available, predetermined data similar to data of the solubility of methane in water at various pressures for a given temperature.

62. A method of calculating a production characteristic for an undersaturated coalbed methane reservoir as described in claim 57 wherein said step of deducing said bubble point of said formation water comprises the step of utilizing the mathematical functional relationship of solution gas-water ratio as a function of pressure with constants from publicly available predetermined data.

63. A method of calculating a production characteristic for an undersaturated coalbed methane reservoir as described in claim 57 wherein said step of deducing said bubble point of said formation water comprises the step of combining functional foundations of a plurality of relationships to achieve a predicted relationship of bubble point to pressure of the desired pressure range applicable to the particular situation.

64. A method of calculating a production characteristic for an undersaturated coalbed methane reservoir as described in claim 57 wherein said step of deducing said bubble point of said formation water comprises the steps of:

a. extrapolating beyond measured data; and b. utilizing an expected zero crossing point.

65. A method of calculating a production characteristic for an undersaturated coalbed methane reservoir as described in claim 57 wherein said step of deducing said bubble point of said formation water comprises the step of ignoring corrections to data for temperatures of less than one hundred degrees Fahrenheit.

66. A method of calculating a production characteristic for an undersaturated coalbed methane reservoir as described in claim 57 wherein said step of deducing said bubble point of said formation water comprises the step of ignoring corrections to data for other than fresh water.

67. A method of calculating a production characteristic for an undersaturated coalbed methane reservoir as described in claim 57 wherein said step of deducing said bubble point of said formation water comprises the step of ignoring corrections to data for sorbed gas other than methane.

68. A method of calculating a production characteristic for an undersaturated coalbed methane reservoir as described in claim 57 wherein said step of deducing said bubble point of said formation water comprises the step of utilizing publicly available, predetermined values for various temperature effects.

69. A method of calculating a production characteristic for an undersaturated coalbed methane reservoir as described in claim 57 wherein said step of deducing said bubble point of said formation water comprises the steps of:

a. utilizing predetermined data having a lowest pressure at a pressure greater than that of interest; and b. extrapolating from said lowest pressure for said predetermined data to a substantially zero value at a zero pressure to obtain data applicable to a pressure of interest.

70. A method of calculating a production characteristic for an undersaturated coalbed methane reservoir as described in claim 69 wherein said step of utilizing predetermined data having a lowest pressure at a pressure greater than that of interest comprises the step of utilizing salinity-based predetermined data.

71. A method of calculating a production characteristic for an undersaturated coalbed methane reservoir as described in claim 44 wherein said step of sampling formation water from said undersaturated coalbed methane reservoir comprises the step of sampling by a downhole device.

72. A method of calculating a production characteristic for an undersaturated coalbed methane reservoir as described in claim 1 wherein said step of conducting a test based on said formation water sample comprises the step of capturing gas from said undersaturated coalbed methane reservoir.

73. A method of calculating a production characteristic for an undersaturated coalbed methane reservoir as described in claim 72 wherein said step of conducting a test based on said formation water sample comprises the step of separating gas and formation water from said well.

74. A method of calculating a production characteristic for an undersaturated coalbed methane reservoir as described in claim 73 wherein said step of separating gas and formation water from said well comprises the step of utilizing a bubble pail apparatus on site.

75. A method of calculating a production characteristic for an undersaturated coalbed methane reservoir as described in claim 73 wherein said step of separating gas and formation water from said well comprises the step of utilizing a separation barrel apparatus and an orifice well tester on site.

76. A method of calculating a production characteristic for an undersaturated coalbed methane reservoir as described in claim 73 wherein said step of conducting a test based on said formation water sample further comprises the step of accounting for gas remaining dissolved in said formation water at surface conditions.

77. A method of calculating a production characteristic for an undersaturated coalbed methane reservoir as described in claim 73 wherein said step of conducting a test based on said formation water sample comprises the steps of:

a. factoring in a surface temperature effect; and b. factoring in a surface pressure effect.

78. A method of calculating a production charactistic for an undersaturated coalbed methane reservoir as described in claim 73 wherein said step of conducting a test based on said formation water sample comprises the step of ignoring a correction for gas remaining dissolved in said formation water in surface conditions.

79. A method of calculating a production charactistic for an undersaturated coalbed methane reservoir as described in claim 72 wherein said step of conducting a test based on said formation water sample comprises the step of factoring in composition of gases obtained from said well.

80. A method of calculating a production characteristic for an undersaturated coalbed methane reservoir as described in claim 79 wherein said step of sampling formation water from said undersaturated coalbed methane reservoir comprises the step of sampling by a downhole device.

81. A method of calculating a production charactistic for an undersaturated coalbed methane reservoir as described in claim 79 wherein said step of factoring in composition of gases obtained from said well comprises the step of testing a composition of said gas for only a limited number of wells in a reservoir area.

82. A method of calculating a production charactistic for an undersaturated coalbed methane reservoir as described in claim 79 wherein said step of conducting a test based on said formation water sample comprises the step of testing for contaminants present in a sample.

83. A method of calculating a production charactistic for an undersaturated coalbed methane reservoir as described in claim 82 wherein said step of testing for contaminants present in a sample comprises the step of comparing data from a sample from said well to other data in a reservoir area.

84. A method of calculating a production charactistic for an undersaturated coalbed methane reservoir as described in claim 79 wherein said step of sampling formation water from said undersaturated coalbed methane reservoir comprises the step of additionally sampling formation water from said undersaturated coalbed methane reservoir if any contaminants are deemed to be present.

85. A method of calculating a production charactistic for an undersaturated coalbed methane reservoir as described in claim 72 wherein said step of conducting a test based on said formation water sample comprises the steps of:

a. releasing a limited amount of pressure from a contained volume; and b. observing a pressure buildup within said contained volume.

86. A method of calculating a production characteristic for an undersaturated coalbed methane reservoir as described in claim 1 wherein said step of inductively quantifying a methane content characteristic of sorbed methane that is sorbed in a solid formation substance from said water sample comprises the step of inferring a critical desorption pressure for a methane-containing solid from said step of conducting a test based on said formation water sample.

87. A method of calculating a production characteristic for an undersaturated coalbed methane reservoir as described in claim 1 wherein said step of inductively quantifying a methane content characteristic of sorbed methane that is sorbed in a solid formation substance from said water sample comprises the step of utilizing an inverse gas-water ratio functional relationship.

88. A method of calculating a production characteristic for an undersaturated coalbed methane reservoir as described in claim 87 wherein said step of sampling formation water from said undersaturated coalbed methane reservoir comprises the step of sampling by a downhole device.

89. A method of calculating a production characteristic for an undersaturated coalbed methane reservoir as described in claim 1 wherein said step of calculating an economic production characteristic for said coalbed methane reservoir comprises the step of determining a likely amount of methane production available from said well upon production.

90. A method of calculating a production characteristic for an undersaturated coalbed methane reservoir as described in claim 89 wherein said step of determining a likely amount of methane production available from said well upon production comprises the step of utilizing an inferred critical desorption pressure for a solid within said undersaturated coalbed methane reservoir.

91. A method of calculating a production characteristic for an undersaturated coalbed methane reservoir as described in claim 90 wherein said step of calculating an economic production characteristic for said coalbed methane reservoir comprises the step of utilizing a saturated coalbed methane isotherm for said undersaturated coalbed methane reservoir.

92. A method of calculating a production characteristic for an undersaturated coalbed methane reservoir as described in claim 91 wherein said step of utilizing a saturated coalbed methane isotherm for said undersaturated coalbed methane reservoir comprises the step of utilizing data representative of a Langmuir isotherm.

93. A method of calculating a production charactistic for an undersaturated coalbed methane reservoir as described in claim 92 wherein said step of utilizing data representative of a Langmuir isotherm comprises the step of fitting a curve for a Langmuir isotherm to measured data for said well.

94. A method of calculating a production characteristic for an undersaturated coalbed methane reservoir as described in claim 91 wherein said step of sampling formation water from said undersaturated coalbed methane reservoir comprises the step of in situ testing said formation water by a downhole measuring device.

95. A method of calculating a production charactistic for an undersaturated coalbed methane reservoir as described in claim 91 wherein said step of utilizing a saturated coalbed methane isotherm for said undersaturated coalbed methane reservoir comprises the step of utilizing publicly available, predetermined isotherm data.

96. A method of calculating a production charactistic for an undersaturated coalbed methane reservoir as described in claim 91 wherein said step of utilizing a saturated coalbed methane isotherm for said undersaturated coalbed methane reservoir comprises the step of utilizing data determined for another well within a reservoir area.

97. A method of calculating a production charactistic for an undersaturated coalbed methane reservoir as described in claim 91 wherein said step of utilizing a saturated coalbed methane isotherm for said undersaturated coalbed methane reservoir comprises the step of utilizing coal-type ranked data.

98. A method of calculating a production charactistic for an undersaturated coalbed methane reservoir as described in claim 97 wherein said step of utilizing coal-type ranked data comprises the steps of:

a. converting from production values to create data representative of amount of gas as a function of pressure;

b. determining appropriate Langmuir-type parameters;

c. applying said appropriate Langmuir-type parameters to said data;

d. creating an approximate gas-water functional relationship for said formation water from said undersaturated coalbed methane reservoir; and e. utilizing said approximate gas-water functional relationship for said undersaturated coalbed methane reservoir in characterizing said undersaturated coalbed methane reservoir.

99. A method of calculating a production charactistic for an undersaturated coalbed methane reservoir as described in claim 91 wherein said step of utilizing a saturated coalbed methane isotherm for said undersaturated coalbed methane reservoir comprises the step of utilizing isotherm data for a different well in a same reservoir area.

100. A method of calculating a production charactistic for an undersaturated coalbed methane reservoir as described in claim 91 wherein said step of utilizing a saturated coalbed methane isotherm for said undersaturated coalbed methane reservoir comprises the step of creating an approximate isotherm for said undersaturated coalbed methane reservoir.

101. A method of calculating a production charactistic for an undersaturated coalbed methane reservoir as described in claim 100 wherein said step of creating an approximate isotherm for said undersaturated coalbed methane reservoir comprises the steps of:

a. utilizing at least one measured data point;

b. utilizing an expected zero crossing point; and c. fitting an anticipated curve shape to said data points.

102. A method of calculating a production charactistic for an undersaturated coalbed methane reservoir as described in claim 100 wherein said step of creating an approximate isotherm for said undersaturated coalbed methane reservoir comprises the step of utilizing a Langmuir-type curve shape.

103. A method of calculating a production characteristic for an undersaturated coalbed methane reservoir as described in claim 1 wherein said step of calculating an economic production characteristic for said coalbed methane reservoir comprises the step of estimating a dewatering value for said reservoir.

104. A method of calculating a production characteristic for an undersaturated coalbed methane reservoir as described in claim 103 wherein said step of sampling formation water from said undersaturated coalbed methane reservoir comprises the step of sampling by a downhole device.

105. A method of calculating a production characteristic for an undersaturated coalbed methane reservoir as described in claim 1 and further comprising the step of commercially producing methane from said well.

106. A method of calculating a production charactistic for an undersaturated coalbed methane reservoir as described in claim 105 wherein said step of accessing a well admitted to an undersaturated coalbed methane reservoir comprises the step of accessing a low permeability well admitted to an undersaturated coalbed methane reservoir.

107. A method of calculating a production charactistic for an undersaturated coalbed methane reservoir as described in claim 105 wherein said step of accessing a well admitted to an undersaturated coalbed methane reservoir comprises the step of accessing a shut in well admitted to an undersaturated coalbed methane reservoir.

108. A method of calculating a production charactistic for an undersaturated coalbed methane reservoir as described in claim 105 wherein said step of accessing a well admitted to an undersaturated coalbed methane reservoir comprises the step of accessing an unproductive well admitted to an undersaturated coalbed methane reservoir.

109. A method of calculating a production characteristic for an undersaturated coalbed methane reservoir as described in claim 1 wherein said step of calculating an economic production characteristic for said coalbed methane reservoir comprises the step of determining an approximate drop in reservoir pressure needed for gas to be produced from said well.

110. A method of calculating a production characteristic for an undersaturated coalbed methane reservoir as described in claim 109 wherein said step of sampling formation water from said undersaturated coalbed methane reservoir comprises the step of sampling by a downhole device.

111. A method of calculating a production characteristic for an undersaturated coalbed methane reservoir as described in claim 1 wherein said step of calculating an economic production characteristic for said coalbed methane reservoir comprises the step of estimating an economic factor for commercial production from said well.

112. A method of calculating a production characteristic for an undersaturated coalbed methane reservoir as described in claim 111 wherein said step of estimating an economic factor for commercial production from said well comprises the step of prioritizing a plurality of wells based on economic considerations.

113. A method of calculating a production characteristic for an undersaturated coalbed methane reservoir as described in claim 1 wherein said step of calculating an economic production characteristic for said coalbed methane reservoir comprises the step of comparing said well to screening criterion.

114. A method of calculating a production characteristic for an undersaturated coalbed methane reservoir as described in claim 113 wherein said step of comparing said well to a screening criterion comprises the step of comparing said well to a screening criterion selected from a group consisting of: a screening criterion based upon a reservoir pressure, a screening criterion based upon a permeability of said undersaturated coalbed methane reservoir, a screening criterion based upon the apparent critical desorption pressure of coal in said undersaturated coalbed methane reservoir, a screening criterion based upon the estimated dewatering needs of said undersaturated coalbed methane reservoir, a screening criterion based upon the degree of undersaturation of said undersaturated coalbed methane reservoir, a screening criterion based upon current prices of gas, a screening criterion based upon projected prices of gas, and a set value of gas content.

115. A method of calculating a production characteristic for an undersaturated coalbed methane reservoir as described in claim 1 and further comprising the step of commercially producing methane from a well that had previously been deemed to be uneconomic.

116. A method of calculating a production characteristic for an undersaturated coalbed methane reservoir as described in claim 111 wherein said step of sampling formation water from said undersaturated coalbed methane reservoir comprises the step of sampling by a downhole device.

117. A method of calculating a production characteristic for an undersaturated coalbed methane reservoir as described in claim 1 wherein said step of sampling formation water from said undersaturated coalbed methane reservoir comprises the step of obtaining multiple samples of formation water from said well.

118. A method of calculating a production characteristic for an undersaturated coalbed methane reservoir as described in claim 117 and further comprising the step of achieving a constancy in said multiple samples of formation water from said well.

119. A method of calculating a production characteristic for an undersaturated coalbed methane reservoir as described in claim 118 wherein said step of achieving a constancy in said comparing the results of said multiple similar tests through alteration of actions affecting said step of sampling formation water from said undersaturated coalbed methane reservoir comprises the step of achieving a substantially constant gas-water ratio result for said formation water.

120. A method of calculating a production characteristic for an undersaturated coalbed methane reservoir as described in claim 119 wherein said step of sampling formation water from said undersaturated coalbed methane reservoir comprises the step of sampling by a downhole device.

121. A method of calculating a production characteristic for an undersaturated coalbed methane reservoir as described in claim 118 wherein said step of achieving a constancy in said comparing the results of said multiple similar tests through alteration of actions affecting said step of sampling formation water from said undersaturated coalbed methane reservoir comprises the step of achieving a substantially constant bubble point result for said formation water.

122. A method of calculating a production characteristic for an undersaturated coalbed methane reservoir as described in claim 118 wherein said step of achieving a constancy in said comparing the results of said multiple similar tests through alteration of actions affecting said step of sampling formation water from said undersaturated coalbed methane reservoir comprises the step of achieving a substantially constant critical desorption pressure result.

123. A method of calculating a production characteristic for an undersaturated coalbed methane reservoir as described in claim 118 wherein said step of sampling formation water from said undersaturated coalbed methane reservoir comprises the step of capturing both gas and water from said well.

124. A method of calculating a production charactistic for an undersaturated coalbed methane reservoir as described in claim 123 wherein said step of sampling formation water from said undersaturated coalbed methane reservoir comprises the step of sampling both formation water and desolubilized methane.

125. A method of calculating a production charactistic for an undersaturated coalbed methane reservoir as described in claim 118 wherein said step of achieving a constancy in said comparing the results of said multiple similar tests through alteration of actions affecting said step of sampling formation water from said undersaturated coalbed methane reservoir comprises the step of altering a production rate from said well.

126. A method of calculating a production charactistic for an undersaturated coalbed methane reservoir as described in claim 118 wherein said step of conducting a test based on said formation water sample comprises the step of factoring in composition of gases obtained from said well.

127. A method of calculating a production charactistic for an undersaturated coalbed methane reservoir as described in claim 118 wherein said step of achieving a constancy in said comparing the results of said multiple similar tests through alteration of actions affecting said step of sampling formation water from said undersaturated coalbed methane reservoir comprises the step of altering a choke valve in said well.

128. A method of calculating a production charactistic for an undersaturated coalbed methane reservoir as described in claim 118 wherein said step of sampling formation water from said undersaturated coalbed methane reservoir comprises the step of sampling both formation water and solubilized methane.

129. A method of calculating a production charactistic for an undersaturated coalbed methane reservoir as described in claim 118 wherein said step of sampling formation water from said undersaturated coalbed methane reservoir comprises the step of additionally sampling formation water from said undersaturated coalbed methane reservoir over a relatively long sampling timeframe.

130. A method of calculating a production charactistic for an undersaturated coalbed methane reservoir as described in claim 129 wherein said step of additionally sampling formation water from said undersaturated coalbed methane reservoir over a relatively long sampling timeframe comprises the step of additionally sampling formation water from said undersaturated coalbed methane reservoir over a relatively long sampling timeframe selected from a group consisting of: at least about multiple hours, at least about a day, at least about multiple days, and at least about a week.

131. A method of calculating a production charactistic for an undersaturated coalbed methane reservoir as described in claim 118 wherein said step of sampling formation water from said undersaturated coalbed methane reservoir comprises the step of achieving a substantially stable flow rate at the time of said sampling.

132. A method of calculating a production charactistic for an undersaturated coalbed methane reservoir as described in claim 118 wherein said step of sampling formation water from said undersaturated coalbed methane reservoir comprises the step of sampling only when achieving a substantially constant fluid production at the time of sampling.

133. A method of calculating a production charactistic for an undersaturated coalbed methane reservoir as described in claim 118 wherein said step of achieving a constancy in said comparing the results of said multiple similar tests through alteration of actions affecting said step of sampling formation water from said undersaturated coalbed methane reservoir comprises the step of producing from said well until a measured value is constant.

134. A method of calculating a production charactistic for an undersaturated coalbed methane reservoir as described in claim 118 wherein said step of sampling formation water from said undersaturated coalbed methane reservoir comprises the step of effecting only a small drawdown.

135. A method of calculating a production charactistic for an undersaturated coalbed methane reservoir as described in claim 118 wherein said step of sampling formation water from said undersaturated coalbed methane reservoir comprises the step of maintaining a pressure at at least a bubble point of said formation water.

136. A method of calculating a production charactistic for an undersaturated coalbed methane reservoir as described in claim 118 wherein said step of accessing a well admitted to an undersaturated coalbed methane reservoir comprises the step of producing from a new well from at least one day prior to accomplishing said step of sampling formation water from said undersaturated coalbed methane reservoir.

137. A method of calculating a production characteristic for an undersaturated coalbed methane reservoir as described in claim 1 and further comprising the steps of:

a. permitting a pressure in said undersaturated coalbed methane reservoir to go below a critical desorption pressure of said undersaturated coalbed methane reservoir; and b. affirmatively allowing pressure to in said undersaturated coalbed methane reservoir to naturally rebuild to a pressure above said critical desorption pressure of said undersaturated coalbed methane reservoir prior to accomplishing said step of sampling formation water from said undersaturated coalbed methane reservoir.

138. A method of calculating a production characteristic for an undersaturated coalbed methane reservoir as described in claim 1 wherein said step of conducting a test based on said formation water sample comprises the step of factoring in composition of said formation water.

139. A method of calculating a production characteristic for an undersaturated coalbed methane reservoir as described in claim 138 wherein said step of factoring in composition of said formation water comprises the step of utilizing a salinity for said formation water.

140. A method of calculating a production characteristic for an undersaturated coalbed methane reservoir as described in claim 138 wherein said step of factoring in composition of said formation water comprises the step of testing a composition of said formation water.

141. A method of calculating a production characteristic for an undersaturated coalbed methane reservoir as described in claim 140 wherein said step of sampling formation water from said undersaturated coalbed methane reservoir comprises the step of sampling by a downhole device.

142. A method of calculating a production characteristic for an undersaturated coalbed methane reservoir as described in claim 140 wherein said step of testing a composition of said formation water comprises the step of testing a composition of said formation water for only a limited number of wells in a reservoir area.

143. A method of calculating a production characteristic for an undersaturated coalbed methane reservoir as described in claim 138 wherein said step of factoring in composition of said formation water comprises the step of inferring a composition for said formation water.

144. A method of calculating a production characteristic for an undersaturated coalbed methane reservoir as described in claim 143 wherein said step of inferring a composition for said formation water comprises the step of utilizing data for nearby formation water.

145. A method of calculating a production characteristic for an undersaturated coalbed methane reservoir as described in claim 1 wherein said step of conducting a test based on said formation water sample comprises the step of determining a naturally occurring temperature for said formation water.

146. A method of calculating a production characteristic for an undersaturated coalbed methane reservoir as described in claim 145 wherein said step of determining a naturally occurring temperature for said formation water comprises the steps of:

a. assessing a well depth; and b. utilizing an applicable geothermal temperature gradient for said well depth.

147. A method of calculating a production characteristic for an undersaturated coalbed methane reservoir as described in claim 145 wherein said step of determining a naturally occurring temperature for said formation water comprises the step of directly measuring a well temperature.

148. A method of calculating a production charactistic for an undersaturated coalbed methane reservoir as described in claim 1 further comprising the step of calculating an economic production characteristic for said coalbed methane reservoir comprises the step of avoiding production from wells that are not economic.

149. A method of calculating a production charactistic for an undersaturated coalbed methane reservoir as described in claim 1 further comprising the step of calculating an economic production characteristic for said coalbed methane reservoir comprises the step of characterizing a plurality of wells prior to beginning commercial methane production.

150. A method of calculating a production charactistic for an undersaturated coalbed methane reservoir as described in claim 149 wherein said step of characterizing a plurality of wells prior to beginning commercial methane production comprises the step of characterizing a plurality of wells in a reservoir area prior to beginning commercial methane production.

151. A method of calculating a production charactistic for an undersaturated coalbed methane reservoir as described in claim 1 wherein said step of calculating an economic production characteristic for said coalbed methane reservoir comprises the step of estimating a dewatering value for said well.

152. A method of calculating a production charactistic for an undersaturated coalbed methane reservoir as described in claim 1 wherein said step of sampling formation water from said undersaturated coalbed methane reservoir comprises the step of conducting multiple similar sampling of said formation water from said well, wherein said step of conducting a test based on said formation water sample comprises the step of conducting multiple similar tests on said formation water samples, and further comprising the step of comparing the results of said multiple similar tests to determine accuracy of said tests.

153. A method of calculating a production charactistic for an undersaturated coalbed methane reservoir as described in claim 152 wherein said step of conducting multiple similar tests on said formation water samples, and further comprising the step of comparing the results of said multiple similar tests to determine accuracy of said tests comprises the steps of:

a. accomplishing initial production from said well for a relatively long pre-sampling period;

b. initially sampling formation water from said undersaturated coalbed methane reservoir;

c. accomplishing additional production from said well for a relatively long sampling period;

d. additionally sampling formation water from said undersaturated coalbed methane reservoir; and e. comparing results of said initial sampling and said additional sampling.

154. A method of calculating a production charactistic for an undersaturated coalbed methane reservoir as described in claim 153 wherein said step of accomplishing initial production from said well for a relatively long pre-sampling period comprises the step of accomplishing initial production from said well for a relatively long pre-sampling period selected from a group consisting of: at least about multiple hours, at least about six hours, at least about twelve hours, at least about a day, at least about multiple days, and at least about a week.

155. A method of calculating a production charactistic for an undersaturated coalbed methane reservoir as described in claim 153 wherein said step of comparing results of said initial sampling and said additional sampling comprises the step of comparing results of said initial sampling and said additional sampling for constancy.

156. A method of calculating a production charactistic for an undersaturated coalbed methane reservoir as described in claim 155 wherein said step of accomplishing additional production from said well for a relatively long sampling period and said step of additionally sampling formation water from said undersaturated coalbed methane reservoir are repeated until said step of comparing results of said initial sampling and said additional sampling for constancy yields a constant result.

157. A method of calculating a production charactistic for an undersaturated coalbed methane reservoir as described in claim 1 and further comprising the step of assessing a saturation character of said well.

158. A method of calculating a production charactistic for an undersaturated coalbed methane reservoir as described in claim 157 wherein said step of assessing a saturation character of said well comprises the step of determining a water production of said well at about the time of initial production from said well.

159. A method of calculating a production charactistic for an undersaturated coalbed methane reservoir as described in claim 157 wherein said step of assessing a saturation character of said well comprises the steps of:

a. determining a gauge pressure from said well; and b. determining a reservoir pressure for said undersaturated coalbed methane reservoir.

160. A method of calculating a production charactistic for an undersaturated coalbed methane reservoir as described in claim 159 wherein said step of assessing a saturation character of said well comprises the step of comparing said gauge pressure to said reservoir pressure.

161. A method of calculating a production charactistic for an undersaturated coalbed methane reservoir as described in claim 157 wherein said step of assessing a saturation character of said well comprises the step of evaluating said well over a relatively long sampling timeframe.

162. A method of calculating a production charactistic for an undersaturated coalbed methane reservoir as described in claim 161 wherein said step of evaluating said well over a relatively long sampling timeframe comprises the step of evaluating said well over a relatively long sampling timeframe selected from a group consisting of: at least about one hour, at least about multiple hours, at least about a day, and at least about multiple days.

163. A method of calculating a production characteristic for an undersaturated coalbed methane reservoir comprising the steps of:

a. accessing an existing well admitted to a coalbed methane reservoir;
b. sampling formation water from said coalbed methane reservoir;
c. conducting a test based on said formation water sample;
d. estimating an economic factor for commercial production from said well based upon said step of conducting a test based on said formation water sample by calculating a transformation to provide a report relating gas content in water to gas content in said coalbed methane reservoir; and
e. applying said economic factor to calculate and report a practical production quantity for said coalbed methane reservoir.

164. A method of calculating a production characteristic for an undersaturated coalbed methane reservoir as described in claim 163 wherein said step of accessing an existing well admitted to a coalbed methane reservoir comprises the step of accessing an existing water producing well admitted to a coalbed methane reservoir.

165. A method of calculating a production characteristic for an undersaturated coalbed methane reservoir as described in claim 163 wherein said step of estimating an economic factor for commercial production from said well based upon said step of conducting a test based on said formation water sample comprises the step of estimating when said well is likely to commercially produced methane.

166. A method of calculating a production characteristic for an undersaturated coalbed methane reservoir as described in claim 165 wherein said step of sampling formation water from said coalbed methane reservoir comprises the step of sampling by a downhole device.

167. A method of calculating a production charactistic for an undersaturated coalbed methane reservoir as described in claim 163 wherein said step of accessing an existing well admitted to an undersaturated coalbed methane reservoir comprises the step of assessing a saturation character of said well.

168. A method of calculating a production characteristic for an undersaturated coalbed methane reservoir as described in claim 163 wherein said step of sampling formation water from said coalbed methane reservoir comprises the step of sampling by a downhole device.

169. A dynamic method of surface sampling subsurface formation water to quantify a methane content value of the formation comprising the steps of:

a. accessing a well admitted to an undersaturated coalbed methane reservoir;
b. assuring that a formation water sample is representative of fluid from said undersaturated coalbed methane reservoir;
c. initially sampling formation water from said undersaturated coalbed methane reservoir;
d. conducting an initial test based on said initial formation water sample;
e. additionally sampling formation water from said undersaturated coalbed methane reservoir;
f. conducting a similar test based on said additional formation water sample;
g. comparing results of said initial sampling and said additional sampling; and
h. achieving a constancy in said comparing the results through alteration of actions affecting said step of sampling formation water from said undersaturated coalbed methane reservoir.

170. A dynamic method of surface sampling subsurface formation water to quantify a methane content value of the formation as described in claim 169 wherein said step of achieving a constancy in said comparing the results of said multiple similar tests through alteration of actions affecting said step of sampling formation water from said undersaturated coalbed methane reservoir comprises the step of altering a production rate from said well.

171. A dynamic method of surface sampling subsurface formation water to quantify a methane content value of the formation as described in claim 169 wherein said step of conducting a test based on said formation water sample comprises the step of factoring in composition of gases obtained from said well.

172. A dynamic method of surface sampling subsurface formation water to quantify a methane content value of the formation as described in claim 169 wherein said step of achieving a constancy in said comparing the results of said multiple similar tests through alteration of actions affecting said step of sampling formation water from said undersaturated coalbed methane reservoir comprises the step of altering a choke valve in said well.

173. A dynamic method of surface sampling subsurface formation water to quantify a methane content value of the formation as described in claim 169 wherein said step of achieving a constancy in said comparing the results of said multiple similar tests through alteration of actions affecting said step of sampling formation water from said undersaturated coalbed methane reservoir comprises the step of achieving a substantially constant gas-water ratio result for said formation water.

174. A dynamic method of surface sampling subsurface formation water to quantify a methane content value of the formation as described in claim 173 wherein said step of initially sampling formation water from said undersaturated coalbed methane reservoir comprises the step of sampling by a downhole device.

175. A dynamic method of surface sampling subsurface formation water to quantify a methane content value of the formation as described in claim 173 wherein said step of achieving a substantially constant gas-water ratio result for said formation water comprises the step of determining the solution gas-water ratio of said formation water in situ by a downhole measuring device.

176. A dynamic method of surface sampling subsurface formation water to quantify a methane content value of the formation as described in claim 169 wherein said step of achieving a constancy in said comparing the results of said multiple similar tests through alteration of actions affecting said step of sampling formation water from said undersaturated coalbed methane reservoir comprises the step of achieving a substantially constant bubble point result for said formation water.

177. A dynamic method of surface sampling subsurface formation water to quantify a methane content value of the formation as described in claim 169 wherein said step of achieving a constancy in said comparing the results of said multiple similar tests through alteration of actions affecting said step of sampling formation water from said undersaturated coalbed methane reservoir comprises the step of achieving a substantially constant critical desorption pressure result.

178. A dynamic method of surface sampling subsurface formation water to quantify a methane content value of the formation as described in claim 169 wherein said step of sampling formation water from said undersaturated coalbed methane reservoir comprises the step of capturing both gas and water from said well.

179. A dynamic method of surface sampling subsurface formation water to quantify a methane content value of the formation as described in claim 178 wherein said step of capturing both gas and water from said well comprises the step of sampling by a downhole device.

180. A dynamic method of surface sampling subsurface formation water to quantify a methane content value of the formation as described in claim 178 and further comprising the step of determining the solution gas-water ratio of said formation water in situ by a downhole measuring device.

181. A dynamic method of surface sampling subsurface formation water to quantify a methane content value of the formation as described in claim 178 wherein said step of sampling formation water from said undersaturated coalbed methane reservoir comprises the step of sampling both formation water and desolubilized methane.

182. A dynamic method of surface sampling subsurface formation water to quantify a methane content value of the formation as described in claim 169 wherein said step of sampling formation water from said undersaturated coalbed methane reservoir comprises the step of sampling both formation water and solubilized methane.

183. A dynamic method of surface sampling subsurface formation water to quantify a methane content value of the formation as described in claim 169 wherein said step of additionally sampling formation water from said undersaturated coalbed methane reservoir comprises the step of additionally sampling formation water from said undersaturated coalbed methane reservoir over a relatively long sampling timeframe.

184. A dynamic method of surface sampling subsurface formation water to quantify a methane content value of the formation as described in claim 183 wherein said step of additionally sampling formation water from said undersaturated coalbed methane reservoir over a relatively long sampling timeframe comprises the step of additionally sampling formation water from said undersaturated coalbed methane reservoir over a relatively long sampling timeframe selected from a group consisting of: at least about multiple hours, at least about a day, at least about multiple days, and at least about a week.

185. A dynamic method of surface sampling subsurface formation water to quantify a methane content value of the formation as described in claim 169 wherein said step of sampling formation water from said undersaturated coalbed methane reservoir comprises the step of achieving a substantially stable flow rate at the time of said sampling.

186. A dynamic method of surface sampling subsurface formation water to quantify a methane content value of the formation as described in claim 169 wherein said step of sampling formation water from said undersaturated coalbed methane reservoir comprises the step of sampling only when achieving a substantially constant fluid production at the time of sampling.

187. A dynamic method of surface sampling subsurface formation water to quantify a methane content value of the formation as described in claim 169 wherein said step of achieving a constancy in said comparing the results of said multiple similar tests through alteration of actions affecting said step of sampling formation water from said undersaturated coalbed methane reservoir comprises the step of producing from said well until a measured value is constant.

188. A dynamic method of surface sampling subsurface formation water to quantify a methane content value of the formation as described in claim 169 wherein said step of sampling formation water from said undersaturated coalbed methane reservoir comprises the step of effecting only a small drawdown.

189. A dynamic method of surface sampling subsurface formation water to quantify a methane content value of the formation as described in claim 169 wherein said step of sampling formation water from said undersaturated coalbed methane reservoir comprises the step of maintaining a pressure at at least a bubble point of said formation water.

190. A dynamic method of surface sampling subsurface formation water to quantify a methane content value of the formation as described in claim 169 wherein said step of accessing a well admitted to an undersaturated coalbed methane reservoir comprises the step of producing from a new well from at least one day prior to accomplishing said step of sampling formation water from said undersaturated coalbed methane reservoir.

* * * * *